US010987937B2

(12) United States Patent
Miyamae

(10) Patent No.: US 10,987,937 B2
(45) Date of Patent: Apr. 27, 2021

(54) IMAGE FORMING APPARATUS AND METHOD OF CONTROLLING IMAGE FORMING APPARATUS

(71) Applicant: KYOCERA Document Solutions Inc., Osaka (JP)

(72) Inventor: Tsubasa Miyamae, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/746,242

(22) Filed: Jan. 17, 2020

(65) Prior Publication Data

US 2020/0247134 A1 Aug. 6, 2020

(30) Foreign Application Priority Data

Feb. 6, 2019 (JP) ..... JP2019-020023

(51) Int. Cl.
*B41J 2/16* (2006.01)
*B41J 2/175* (2006.01)
*B41J 2/285* (2006.01)

(52) U.S. Cl.
CPC ..... *B41J 2/17566* (2013.01)

(58) Field of Classification Search
CPC ..... B41J 2/285; B41J 2/16526; B41J 2/175; B41J 2/17566
See application file for complete search history.

(56) References Cited

U.S. PATENT DOCUMENTS

| | | | | |
|---|---|---|---|---|
| 10,245,835 | B2 * | 4/2019 | Tone | B41J 2/1652 |
| 2002/0085060 | A1 | 7/2002 | Usui et al. | 347/30 |
| 2009/0160915 | A1 * | 6/2009 | Takahashi | B41J 2/17509 347/85 |

FOREIGN PATENT DOCUMENTS

JP 2005-178397 A 7/2005

* cited by examiner

*Primary Examiner* — Jason S Uhlenhake
(74) *Attorney, Agent, or Firm* — Stein IP, LLC

(57) ABSTRACT

A first duct connects a tank and a syringe together. A second duct connects the syringe and a dumper together. A third duct connects the dumper and the tank together. When a time (deformation restoration time) until the swollen dumper is returned to its original shape is determined, a controller deforms the dumper. The controller sets the position of a liquid level in the tank less than a specified position (syringe filling processing). The controller opens the third duct so as to measure a liquid level recovery time until the output of a liquid level sensor is changed (time measurement processing). The controller determines a deformation restoration time based on the liquid level recovery time.

10 Claims, 13 Drawing Sheets

IMAGE FORMING APPARATUS AND METHOD OF CONTROLLING IMAGE FORMING APPARATUS

This application is based upon and claims the benefit of priority from the corresponding Japanese Patent Application No. 2019-020023 filed on Feb. 6, 2019, the entire contents of which are incorporated herein by reference.

BACKGROUND

The present disclosure relates to an image forming apparatus which discharges inks from nozzles so as to perform printing.

An apparatus is present which uses inks so as to perform printing. Such an apparatus has a head which includes a plurality of nozzles. Based on image data, the inks are discharged from the nozzles to a sheet. When the ink is consumed, the ink is supplied from an ink tank to the head. It is likely that the flow path of the ink from the tank to the head can be opened and closed.

A technology as described below is known. Specifically, an inkjet recording device is disclosed in which an ink cartridge where a region capable of closing a flow path is formed in an ink supply path for supplying an ink is removably fitted, in which the region of the ink cartridge can be pressed, in which the supply of the ink from the ink cartridge is received such that a recording head is made to perform printing, in which the recording head is sealed and in which a negative pressure is supplied to a capping means.

A dumper may be provided partway through the flow path of an ink from an ink tank to a head. The dumper is connected to the head. For example, the dumper lowers a variation in a pressure applied to the ink within the nozzles of the head. With the dumper, an abnormality in the discharge of the ink is reduced.

Cleaning which forcibly discharges inks may be performed. In the forcible discharge, for example, a pump is used to pass the inks into a head with a strong force (high pressure). The pressure is applied, and thus the inks are pushed out from the nozzles of the head. Here, the high viscosity inks can be pushed out from the nozzles. It is also possible to remove dust adhered to the nozzles.

When the inks are forcibly discharged, a dumper may be deformed by the pressure applied to the inks. When the pressure resistance of the dumper is lower than the pressure applied to the inks, the dumper is distorted (swollen). When the pressure applied to the inks is reduced (when the passage of the inks into the head is completed), the dumper is returned to its original shape. Even when inks are discharged for printing during shape restoration, it is likely that it is impossible to appropriately discharge the inks. Hence, after a constant waiting time has elapsed since the completion of the forcible discharge (pressure application), the printing (ink discharge) is restarted.

Conventionally, the waiting time is set to a common value in an image forming apparatus. Even in an image forming apparatus in which it takes much time to restore its shape, it is necessary to restart printing after the completion of the shape restoration. Hence, the waiting time is set long. The time necessary for the shape restoration of the dumper is varied depending on the individual image forming apparatus. It is likely that the waiting time after the forcible discharge is disadvantageously longer than necessary. A user is made to wait longer than necessary, and thus the operation time of the image forming apparatus is elongated.

SUMMARY

An image forming apparatus according to the present disclosure includes a head, a tank, a syringe, a dumper, a first duct, a second duct, a third duct, a liquid level sensor and a controller. The head discharges an ink so as to perform printing. The tank stores the ink. The syringe injects or sucks the ink. The dumper supplies the ink to the head, and the ink is injected thereinto with the syringe. The first duct is a flow path for connecting the tank and the syringe together so as to exchange the ink. The second duct is a flow path for connecting the syringe and the dumper together so as to exchange the ink. The third duct is a flow path for connecting the dumper and the tank together so as to exchange the ink. The liquid level sensor detects whether or not a position of the liquid level of the ink within the tank is equal to or greater than a specified position. An output of the liquid level sensor is input to the controller. In a mode for determining a deformation restoration time which is a time until the swollen dumper is returned to an original shape, the controller performs deformation processing, syringe filling processing and time measurement processing in this order. In the deformation processing, the controller closes the first duct and the third duct, and thereafter makes the syringe inject a first ink amount of the ink into the dumper so as to deform the dumper. The controller closes the second duct after the deformation processing. In the syringe filling processing, the controller opens the first duct such that the position of the liquid level is less than the specified position, and makes the syringe suck a second ink amount of the ink from the tank. In the time measurement processing after the syringe filling processing, the controller opens the third duct, and measures a liquid level recovery time which is a time until the output of the liquid level sensor is changed after the opening of the third duct. The controller determines the deformation restoration time based on the liquid level recovery time.

A method of controlling an image forming apparatus according to the present disclosure includes: discharging an ink with a head so as to perform printing; storing the ink in a tank; using a syringe so as to inject or suck the ink; using a dumper so as to supply the ink to the head; using the syringe so as to inject the ink into the dumper; using a first duct so as to connect the tank and the syringe together; using a second duct so as to connect the syringe and the dumper together; using a third duct so as to connect the dumper and the tank together; and using a liquid level sensor so as to detect whether or not a position of the liquid level of the ink within the tank is equal to or greater than a specified position. In a mode for determining a deformation restoration time which is a time until the swollen dumper is returned to an original shape, the method includes: performing deformation processing, syringe filling processing and time measurement processing in this order; closing, in the deformation processing, the first duct and the third duct, and thereafter making the syringe inject a first ink amount of the ink into the dumper so as to deform the dumper; closing the second duct after the deformation processing; opening, in the syringe filling processing, the first duct such that the position of the liquid level is less than the specified position, and making the syringe suck a second ink amount of the ink from the tank; opening, in the time measurement processing after the syringe filling processing, the third duct, and measuring a liquid level recovery time which is a time until the output of the liquid level sensor is changed after the opening of the third duct; and determining the deformation restoration time based on the liquid level recovery time.

Further features and advantages of the present invention will become apparent from the description of an embodiment given below.

DETAILED DESCRIPTION

Figure 1:
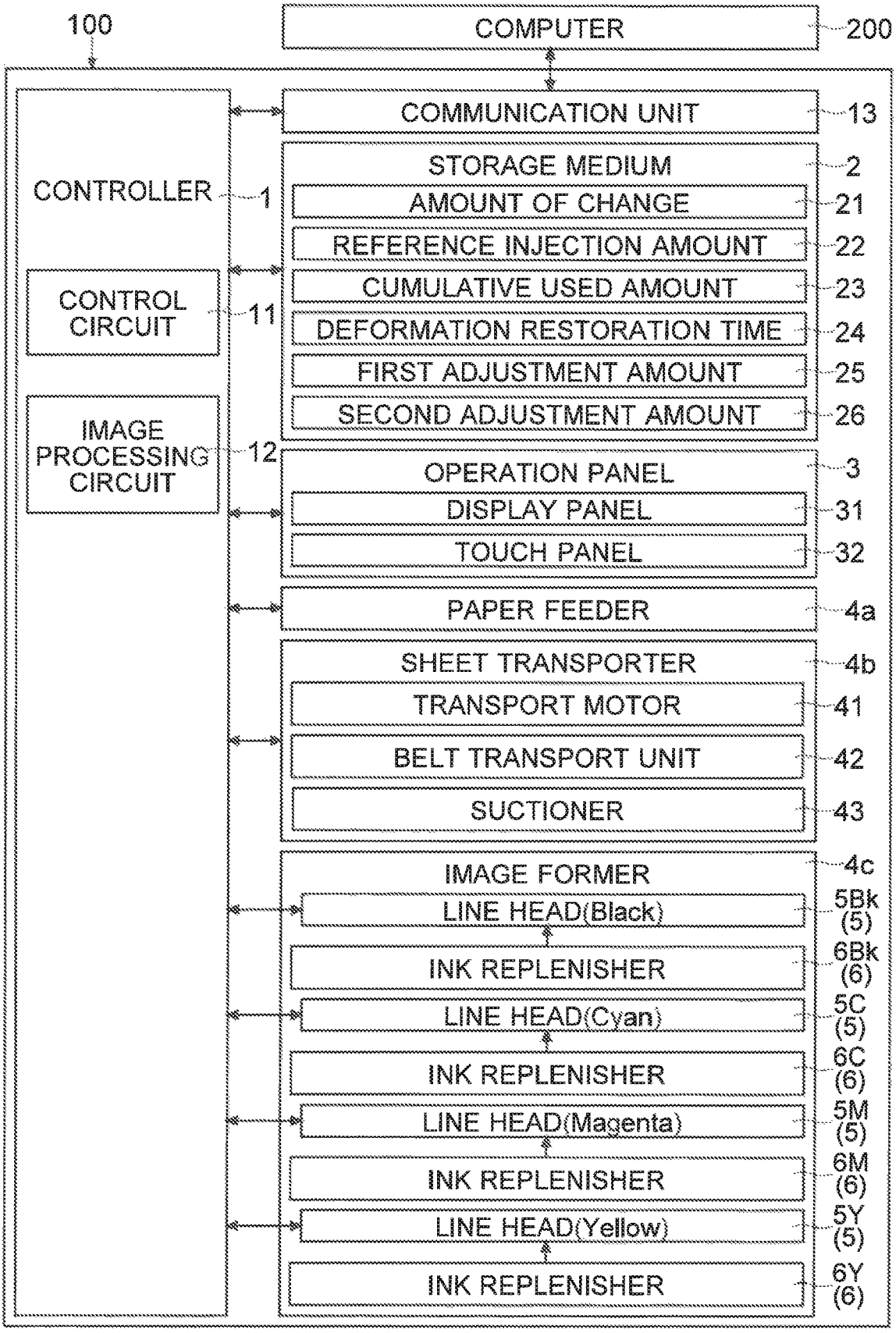
FIG. 1 is a diagram showing an example of a printer according to an embodiment.

In view of the foregoing problem, in the present disclosure, in order for a waiting time to be set to an optimum (minimum necessary) time, a time necessary for the shape restoration of a dumper after inks are forcibly discharged is measured. An embodiment of the present disclosure will be described below with reference to FIGS. 1 to 18. In the following discussion, the description will be given using a printer 100 as an example of an image forming apparatus. The printer 100 is an inkjet printing device which uses inks so as to perform printing. Individual elements such as configurations and arrangements described in the present embodiment do not limit the scope of the disclosure, and are simply examples of the description.

(Outline of Printer 100)

An outline of the printer 100 according to the embodiment will first be described with reference to FIG. 1. The printer 100 includes a controller 1. The controller 1 controls the individual portions of the printer 100. The controller 1 includes a control circuit 11 and an image processing circuit 12. For example, the control circuit 11 is a CPU. Based on a control program and control data stored in a storage medium 2, the control circuit 11 performs computation and processing. The storage medium 2 includes a nonvolatile storage device such as a ROM, a HDD or a flash ROM and a volatile storage device such as a RAM. The image processing circuit 12 performs image processing on image data. The image processing circuit 12 generates image data (ink discharge image data) which is used in printing. The ink discharge image data is data which indicates the discharge and non-discharge of the ink for each of nozzles 51 (pixels).

The printer 100 include an operation panel 3. The operation panel 3 includes a display panel 31 and a touch panel 32. The display panel 31 displays a setting screen and information. The display panel 31 displays operation images such as a softkey, a button and a tub. The touch panel 32 detects a touch operation on the display panel 31. Based on the output of the touch panel 32, the controller 1 recognizes the operation image which is operated. The controller 1 recognizes a setting operation which is performed by a user.

The printer 100 includes a paper feeder 4*a*, a sheet transporter 4*b* and an image former 4*c*. The paper feeder 4*a* stores a bundle of sheets. At the time of a print job, the controller 1 makes the paper feeder 4*a* supply the sheet. The controller 1 makes the sheet transporter 4*b* transport the sheet. The sheet transporter 4*b* includes a transport motor 41 and a rotation member which transports the sheet. The controller 1 rotates the transport motor 41. The transport motor 41 rotates the rotation member. In this way, the sheet supplied from the paper feeder 4*a* is transported toward an ejection tray (unillustrated).

The sheet transporter 4*b* includes a belt transport unit 42 and a suctioner 43. The belt transport unit 42 transports the sheet. The belt transport unit 42 includes a transport belt. The transport belt is circled. The sheet is transported on the transport belt. The suctioner 43 is provided in the belt transport unit 42. The image former 4*c* is provided above the belt transport unit 42. The image former 4*c* is provided above the sheet placed on the transport belt. The suctioner 43 is provided in the belt transport unit 42. The suctioner 43 sucks the sheet to the transport belt. By the sucking, the position of the sheet is prevented from being displaced. It is possible to prevent the discharge position of the inks from being displaced. The controller 1 makes the sheet transporter 4*b* eject the recorded (printed) sheet to the ejection tray.

The image former 4*c* discharges the inks to the transported sheet so as to record (print) an image. As shown in FIG. 1, the printer 100 includes a plurality of line heads 5 (5Bk, 5C, 5M and 5Y). The line heads 5 are fixed (not moved). The line heads 5 are arranged above the transport belt and the transported sheet. The line head 5Bk discharges the ink of black. The line head 5C discharges the ink of cyan. The line head 5M discharges the ink of magenta. The line head 5Y discharges the ink of yellow.

In the line heads 5, ink replenishers 6 (6Bk, 6C, 6M and 6Y) which supply (replenish) the inks are respectively provided. The ink replenisher 6Bk supplies the ink of black to the line head 5 of black. The ink replenisher 6C supplies the ink of cyan to the line head 5 of cyan. The ink replenisher 6M supplies the ink of magenta to the line head 5 of magenta. The ink replenisher 6Y supplies the ink of yellow to the line head 5 of yellow.

The printer 100 includes a communication unit 13. The communication unit 13 includes hardware (a connector and a communication unit) and software for communication. The communication unit 13 communicates with a computer 200. The computer 200 is, for example, a PC or a server. The controller 1 receives print data from the computer 200. The print data includes print settings and the details of printing. For example, the print data includes data which is described in a page description language. The controller 1 (the image processing circuit 12) analyzes the received print data. Based on the received print data, the controller 1 generates image data (raster data) which is used in the image formation of the image former 4*c*. The image processing circuit 12 processes the raster data so as to generate the ink discharge image data.

(Control of Discharge of Inks)

Figure 2:
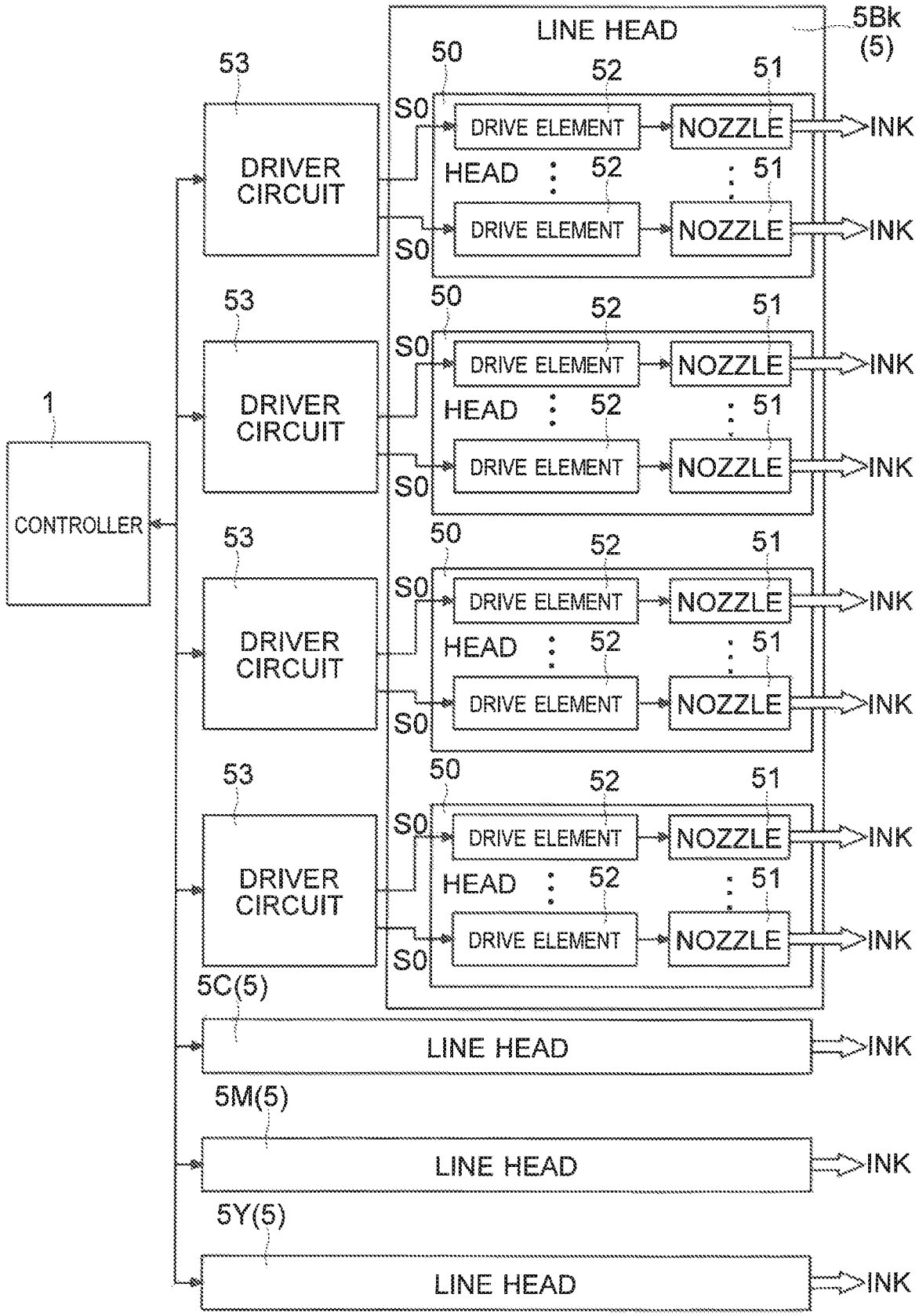
FIG. 2 is a diagram showing an example of ink discharge control of the printer according to the embodiment.

An example of control of discharge of the inks in the printer 100 according to the embodiment will then be described with reference to FIG. 2. The line head 5 of one color includes two or more (a plurality of) heads 50. In other words, the line head 5 is a combination of a plurality of heads 50. In order to form the line head of one color, for example, the heads 50 are arranged in a staggered pattern. Each of the heads 50 includes a plurality of nozzles 51. The heads 50 are fixed such that the nozzles 51 are aligned in a direction perpendicular to a sheet transport direction. The nozzles 51 are aligned in a main scanning direction.

For example, the nozzles 51 are formed by etching or drilling a metal plate. The nozzles 51 are formed such that the intervals therebetween in the main scanning direction are equal to each other. The interval between the nozzle 51 in the main scanning direction is the pitch of one pixel. The openings of the nozzles 51 are opposite the transported sheet. One drive element 52 is provided for each of the nozzles 51. The drive element 52 is a piezoelectric element (piezo element). The drive element 52 discharges the ink from the nozzle 51. As described above, each of the heads 50 includes a plurality of nozzles 51 and a plurality of drive elements 52.

For one or a plurality of heads 50, one or a plurality of driver circuits 53 are provided. FIG. 2 shows an example where one driver circuit 53 is provided for one head 50. One driver circuit 53 may control a plurality of heads 50. The driver circuit 53 inputs a discharge signal S0 to the drive elements 52 corresponding to the nozzles 51 which discharge the ink. The discharge signal S0 is, for example, a pulse. The driver circuit 53 applies the discharge signal S0 so as to control the discharge of the ink from the nozzles 51. The shape of the drive element 52 is deformed by the application of a voltage. Consequently, the pressure of the change of the shape is applied to the nozzle 51 and the flow path which supplies the ink to the nozzle 51. By this pressure, the ink is discharged from the nozzle 51. The ink reaches the transported sheet. In this way, an image is formed (recorded).

The controller 1 (the image processing circuit 12) generates the ink discharge image data for each of the line heads 5 (for each of the colors). The controller 1 transmits the generated ink discharge image data to the heads 50. The ink discharge image data is data (binary data) which indicates the discharge and non-discharge of the ink for each pixel and for each line. The controller 1 (the image processing circuit 12) transmits the image data to the driver circuits 53 for each line in the main scanning direction.

Based on the ink discharge image data, the driver circuit 53 inputs the discharge signal S0 to the drive elements 52 of the nozzles 51 which discharge the ink. On the other hand, the driver circuit 53 does not apply the pulse (voltage) to the drive elements 52 corresponding to the pixels to which the ink is not discharged. In FIG. 2, for convenience, among the line heads 5, part of the interior of only one line head 5Bk is shown. The configurations of the line heads 5 for the individual colors are the same as each other.

The controller 1 may supply a clock signal to the driver circuits 53. Based on the clock signal, the discharge period (frequency) of the ink is determined. In the print job, the frequency (voltage application period) of the discharge signal S0 which is input by the driver circuit 53 to the drive elements 52 is constant. A sheet transport speed is assumed to be a speed at which the sheet is moved one dot (one line) during a period corresponding to one round of discharge. The controller 1 makes the sheet transporter 4*b* transport the sheet at a predetermined sheet transport speed. Based on the image data, the driver circuit 53 applies the voltage to the drive elements 52 of the pixels (the nozzles 51) to which the ink needs to be discharged. This processing is repeated from the beginning to the end of the page in the sheet transport direction (subscanning direction), and thus the one page is printed.

(Ink Replenisher 6)

Figure 3:
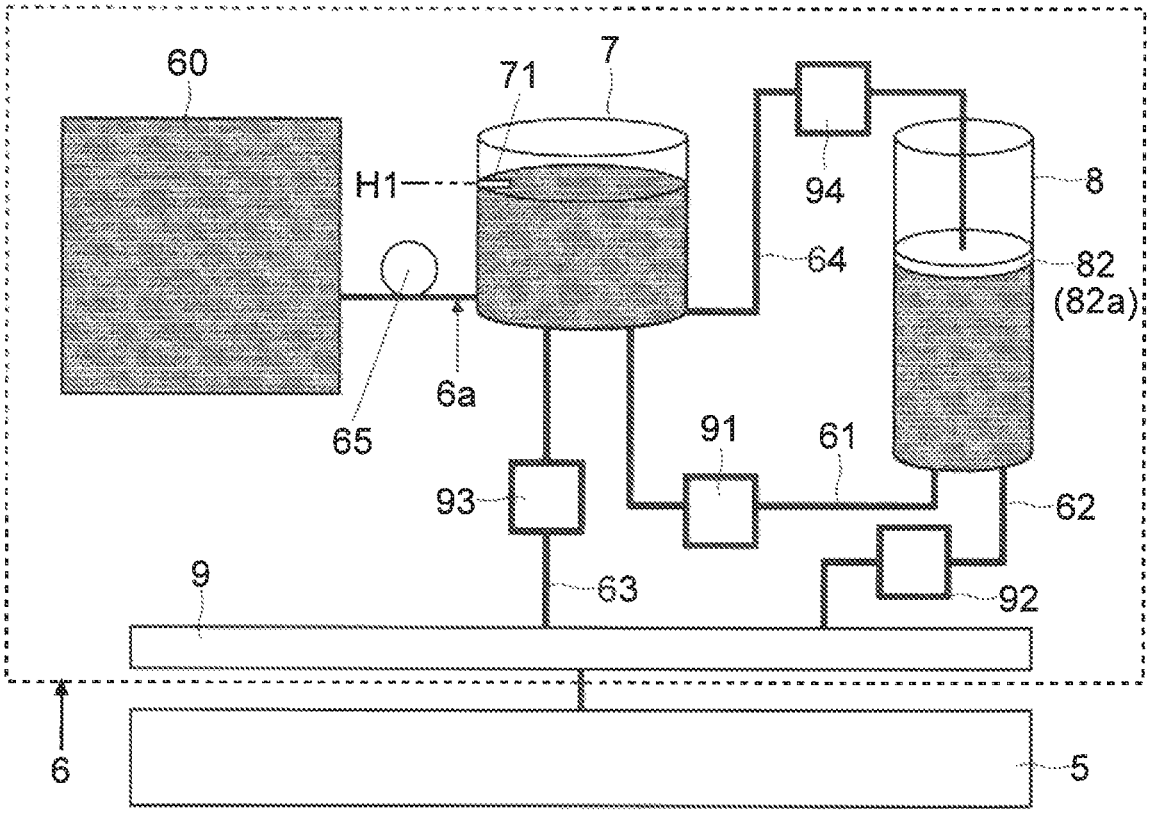
FIG. 3 is a diagram showing an example of an ink replenisher in the embodiment.

An example of the ink replenisher 6 in the embodiment will then be described with reference to FIGS. 3 to 6. The ink replenisher 6 is provided for each of the line heads 5. FIG. 3 is a diagram in which one color is selected from the line heads 5 of the four colors. The ink replenishers 6 of the individual colors have the same configuration. The ink replenishers 6 can be described in the same manner. Hence, in the following discussion, the description will be given without provision of the symbols of Bk, C, M and Y indicating the colors.

The ink replenisher 6 includes an ink container 60, a tank 7, a syringe 8, a dumper 9, a replenishing pipe 6*a*, a first duct 61, a second duct 62, a third duct 63, a fourth duct 64, a liquid level sensor 71 and a pump 65.

The ink container 60 stores the ink which is replenished to the line head 5. The ink container 60 of black stores the ink of black. The ink container 60 of cyan stores the ink of cyan. The ink container 60 of magenta stores the ink of magenta. The ink container 60 of yellow stores the ink of yellow.

The ink container 60 is connected to the tank 7 with the replenishing pipe 6*a*. The replenishing pipe 6*a* functions as an ink flow path from the ink container 60 to the tank 7. The ink in the ink container 60 is fed to the tank 7 through the replenishing pipe 6*a*. The tank 7 stores the ink. The maximum storage amount of the ink in the tank 7 is less than the maximum storage amount in the ink container 60.

Within the tank 7, the liquid level sensor 71 is provided. The liquid level sensor 71 is a sensor which detects whether or not the position (height) of the liquid level of the ink within the tank 7 is less than a specified position H1 (equal to or greater than the specified position H1). The specified position H1 is the height of the liquid level of the ink which needs to be maintained in the tank 7. For example, the height of about three fourths of the total height of the tank 7 is set to the specified position H1.

When the position of the liquid level is equal to or greater than the specified position H1, the liquid level sensor 71 outputs a voltage of a first level. When the position of the liquid level is less than the specified position H1, the liquid level sensor 71 outputs a voltage of a second level. When the first level is a high level, the second level is a low level. When the first level is a low level, the second level is a high level.

The output of the liquid level sensor 71 is input to the controller 1. Based on the output level of the liquid level sensor 71, the controller 1 can recognize whether or not the position (height) of the liquid level is less than the specified position H1. When the liquid level within the tank 7 is less than the specified position H1 (when the liquid level reaches the second level), the controller 1 operates the pump 65. During the operation, the pump 65 feeds the ink in the ink container 60 into the tank 7. Until the output level of the liquid level sensor 71 is changed to the first level, the controller 1 operates the pump 65. When the output level of the liquid level sensor 71 is changed to the first level, the controller 1 stops the pump 65. The position of the liquid level of the tank 7 is maintained in the specified position H1.

The syringe 8 injects or sucks the ink. For example, the syringe 8 sucks (sucks up) the ink in the tank 7. The syringe 8 also injects (pushes out) the ink into the dumper 9. The dumper 9 receives the ink fed from the syringe 8. The ink in the dumper 9 is supplied to the line head 5 (the heads 50). In other words, the ink in the dumper 9 is supplied to the nozzles 51 and the flow paths of the ink to the nozzles 51 provided within the line head 5. The dumper 9 lowers a variation in the pressure applied to the ink. It is possible to reduce a variation in the amount of the ink discharged when the drive elements 52 are operated.

A plurality of ducts are provided. Each of the ducts functions as a flow path of the ink. The first duct 61 connects the tank 7 and the syringe 8 together. The ink from the tank 7 toward the syringe 8 or from the syringe 8 toward the tank 7 is passed through the first duct 61. The second duct 62 connects the syringe 8 and the dumper 9 together. The ink from the syringe 8 toward the dumper 9 or from the dumper 9 toward the syringe 8 is passed through the second duct 62. The third duct 63 connects the dumper 9 and the tank 7 together. The ink from the dumper 9 toward the tank 7 is passed through the third duct 63.

Furthermore, one end of the fourth duct 64 is connected to the syringe 8. The fourth duct 64 is a pipe for removing air within the syringe 8. The other end of the fourth duct 64 is connected to the tank 7. The air removed from the syringe 8 is blown out into the tank 7. The air blown out into the tank 7 is floated up as air bubbles. The removed air mixes with air on the liquid level.

The printer 100 (the ink replenisher 6) includes a first opening/closing portion 91, a second opening/closing portion 92, a third opening/closing portion 93 and a fourth opening/closing portion 94. The first opening/closing portion 91 opens and closes the first duct 61 (opens and interrupts the ink flow path). The second opening/closing portion 92 opens and closes the second duct 62 (opens and interrupts the ink flow path). The third opening/closing portion 93 opens and closes the third duct 63 (opens and interrupts the ink flow path). The fourth opening/closing portion 94 opens and closes the fourth duct 64 (opens and interrupts the path of the air).

Figure 4:
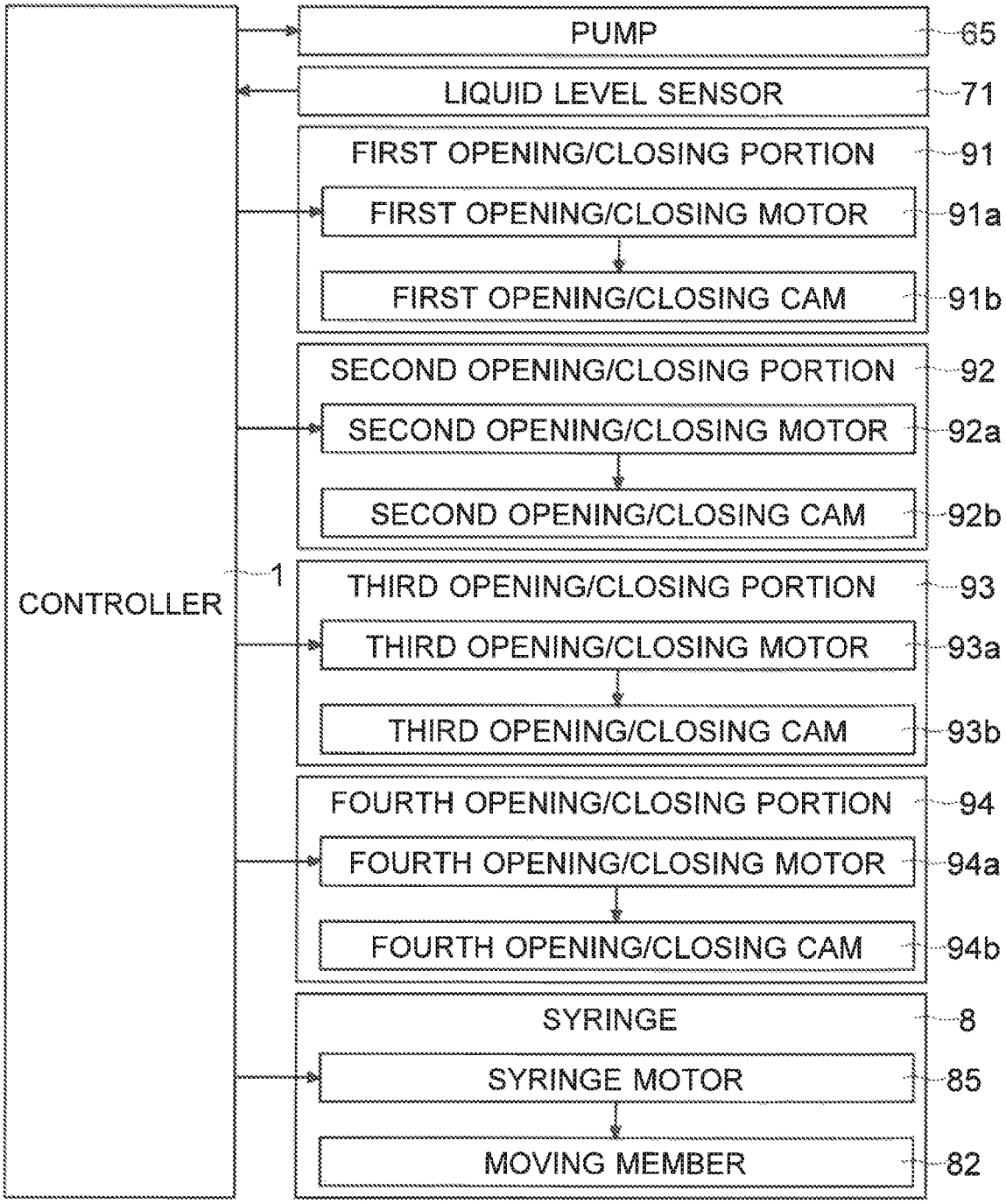
FIG. 4 is a diagram showing the example of the ink replenisher in the embodiment.

As shown in FIG. 4, in order to open and interrupt the first duct 61, the first opening/closing portion 91 includes a first opening/closing motor 91*a* and a first opening/closing cam 91*b*. In order to open and interrupt the second duct 62, the second opening/closing portion 92 includes a second opening/closing motor 92*a* and a second opening/closing cam 92*b*. In order to open and interrupt the third duct 63, the third opening/closing portion 93 includes a third opening/closing motor 93*a* and a third opening/closing cam 93*b*. In order to open and interrupt the fourth duct 64, the fourth opening/closing portion 94 includes a fourth opening/closing motor 94*a* and a fourth opening/closing cam 94*b*.

The first duct 61, the second duct 62, the third duct 63 and the fourth duct 64 are, for example, tubes which are made of rubber. They can be bent or distorted. They are crushed (are pressed from above), and thus the flow of the material (ink or air) within the pipes can be interrupted.

Figure 5:
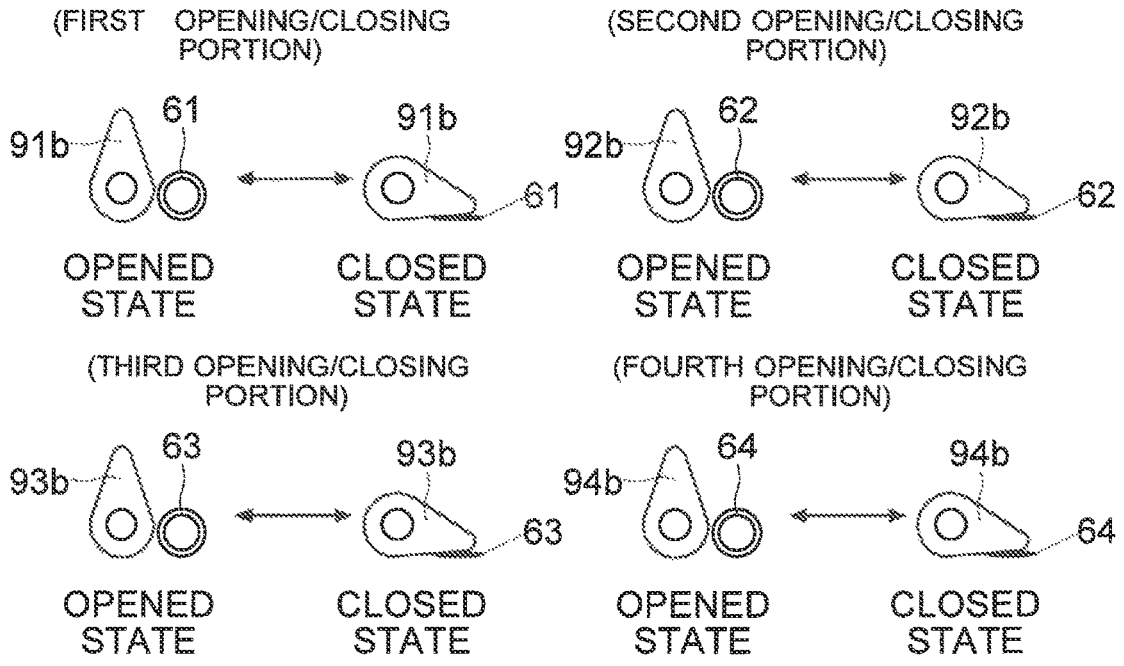
FIG. 5 is a diagram showing an example of opening/closing portions in the embodiment.

As shown in FIG. 5, when the first duct 61 is opened (when the ink is made to flow), the controller 1 rotates (controls) the first opening/closing motor 91*a*. The controller 1 sets the rotation angle of the first opening/closing cam 91*b* to such an angle that the first opening/closing cam 91*b* is prevented from crushing (pressing or making contact with) the first duct 61. When the first duct 61 is closed (when the flow of the ink is interrupted), the controller 1 rotates (controls) the first opening/closing motor 91*a*. The controller 1 sets the rotation angle of the first opening/closing cam 91*b* to such an angle that the first opening/closing cam 91*b* crushes (presses) the first duct 61.

When the second duct 62 is opened (when the ink is made to flow), the controller 1 rotates (controls) the second opening/closing motor 92*a*. The controller 1 sets the rotation angle of the second opening/closing cam 92*b* to such an angle that the second opening/closing cam 92*b* is prevented from crushing (pressing or making contact with) the second duct 62. When the second duct 62 is closed (when the flow of the ink is interrupted), the controller 1 rotates (controls) the second opening/closing motor 92*a*. The controller 1 sets the rotation angle of the second opening/closing cam 92*b* to such an angle that the second opening/closing cam 92*b* crushes (presses) the second duct 62.

When the third duct 63 is opened (when the ink is made to flow), the controller 1 rotates (controls) the third opening/closing motor 93*a*. The controller 1 sets the rotation angle of the third opening/closing cam 93*b* to such an angle that the third opening/closing cam 93*b* is prevented from crushing (pressing or making contact with) the third duct 63. When the third duct 63 is closed (when the flow of the ink is interrupted), the controller 1 rotates (controls) the third opening/closing motor 93*a*. The controller 1 sets the rotation angle of the third opening/closing cam 93*b* to such an angle that the third opening/closing cam 93*b* crushes (presses) the third duct 63.

When the fourth duct 64 is opened (when the air is made to flow), the controller 1 rotates (controls) the fourth opening/closing motor 94*a*. The controller 1 sets the rotation angle of the fourth opening/closing cam 94*b* to such an angle that the fourth opening/closing cam 94*b* is prevented from crushing (pressing or making contact with) the fourth duct 64. When the fourth duct 64 is closed (when the flow of the ink is interrupted), the controller 1 rotates (controls) the fourth opening/closing motor 94*a*. The controller 1 sets the rotation angle of the fourth opening/closing cam 94*b* to such an angle that the fourth opening/closing cam 94*b* crushes (presses) the fourth duct 64.

The syringe 8 will then be described with reference to FIGS. 3 and 6. The syringe 8 includes, for example, an ink tube 81 and a moving member 82 (plunger). The ink tube 81 is cylindrical. The upper side of the ink tube 81 is opened. The first duct 61 and the second duct 62 are connected to the lower side of the ink tube 81.

Figure 6:
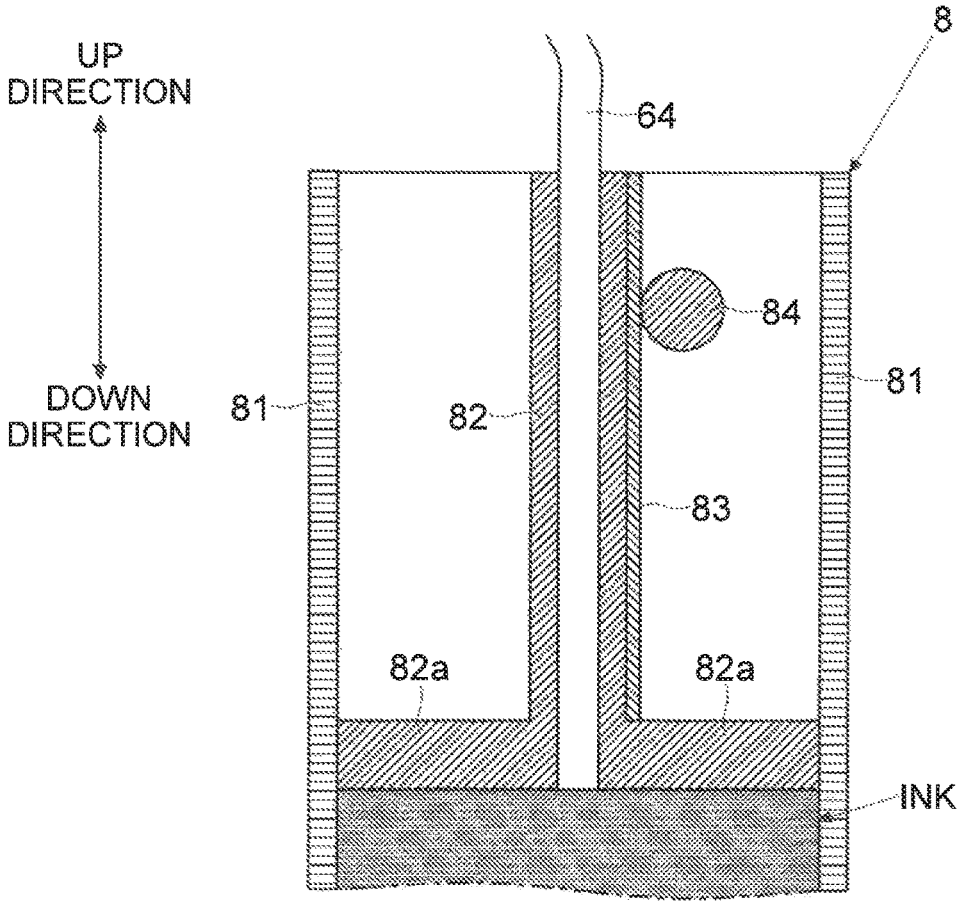
FIG. 6 is a diagram showing an example of a syringe in the embodiment.

As shown in FIG. 6, the moving member 82 is inserted from above the ink tube 81 into the ink tube 81. The cross section of the moving member 82 in a vertical direction is the shape of an inverted letter T. The moving member 82 has the same shape as a pusher of a syringe. The front portion (part on the lower side) of the moving member 82 is an airtight portion 82*a*. The shape of the base area of the airtight portion 82*a* (the moving member 82) is substantially the same as the base area of the inside of the ink tube 81. The airtight portion 82*a* has airtightness. By the airtight portion 82*a*, the ink within the ink tube 81 is prevented from leaking to the upper side of the airtight portion 82*a* (the moving member 82).

The fourth duct 64 is inserted through the inside (center) of the moving member 82. The fourth duct 64 is passed from the uppermost part of the moving member 82 to the bottom surface. When the moving member 82 is moved downward, air within the ink tube 81 and on the lower side of the moving member 82 is removed through the fourth duct 64. The uppermost surface of the ink within the ink tube 81 makes contact with the lower surface of the airtight portion 82*a*. On the side surface of the moving member 82 in an up/down direction (vertical direction), a tooth surface 83 is provided. In the tooth surface 83, teeth are provided along the up/down direction. A gear 84 is provided so as to engage with the teeth. A syringe motor 85 rotates the gear 84. The syringe motor 85 can be freely rotated in forward and reverse directions. The syringe motor 85 is rotated, and thus the moving member 82 can be moved vertically.

When the ink is injected (pushed out) from the syringe 8 into the tank 7 or the dumper 9, the controller 1 rotates the syringe motor 85 in such a direction as to lower the moving member 82. When the ink within the syringe 8 is increased (when the ink is sucked), the controller 1 rotates the syringe motor 85 in such a direction as to raise the moving member 82. At the time of the injection or the suction, the controller 1 closes (interrupts) the fourth duct 64. Before the injection or the suction, the controller 1 opens the fourth duct 64 so as to remove the air within the ink tube 81.

The base area (cross-sectional area in a horizontal direction) of the ink tube 81 is fixed. The base area is multiplied by the amount of movement (height) of the moving member 82 in the up/down direction, and thus the controller 1 can recognize the amount of the ink which is injected or sucked. For example, as the syringe motor 85, a stepping motor can be used. The controller 1 recognizes the amount of lowering of the moving member 82 based on the number of revolutions (rotation angle) of the syringe motor 85 after the start of the injection until the completion thereof. The amount of lowering is multiplied by the base area, and thus the controller 1 recognizes the amount of the ink which is injected.

Likewise, the base area is multiplied by the amount of raising (height) of the moving member 82, and thus the controller 1 can recognize the amount of the ink which is sucked. The controller 1 recognizes the amount of raising of the moving member 82 based on the number of revolutions (rotation angle) of the syringe motor 85 after the start of the suction until the completion thereof. The amount of raising is multiplied by the base area, and thus the controller 1 recognizes the amount of the ink which is sucked.

(Deformation of Dumper 9)

Figure 7:
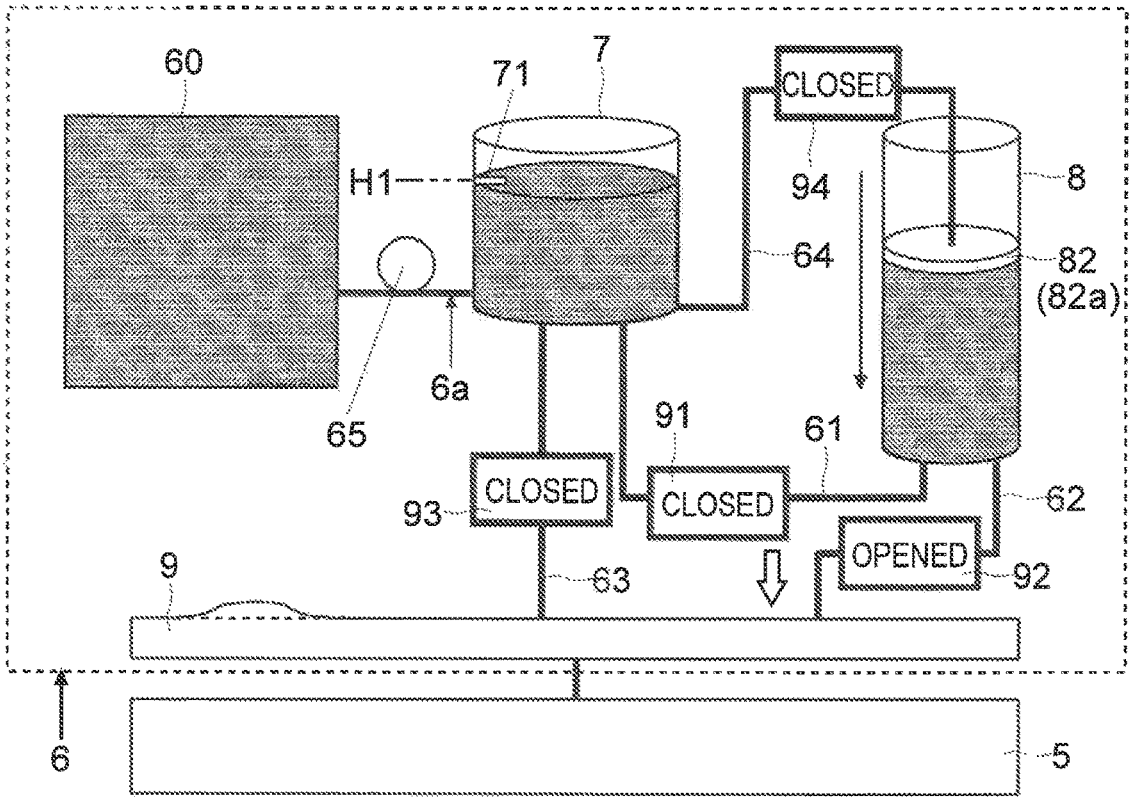
FIG. 7 is a diagram showing an example of deformation of a dumper in the embodiment.

An example of deformation of the dumper 9 in the embodiment will then be described with reference to FIG. 7. In the printer 100, the forcible discharge of the ink can be performed. The forcible discharge is processing in which a pressure is applied to the ink. In order to apply the pressure, the syringe 8 injects the ink into the dumper 9. In this way, the ink is made to flow out from the nozzles 51 of the line head 5. By the forcible discharge, it is possible to discharge the high concentration, high viscosity ink left in the vicinity of the nozzles 51. It may be possible to remove stain adhered to the nozzles 51.

The belt transport unit 42 (the transport belt) can be raised and lowered. In the forcible discharge, the controller 1 moves (lowers) the belt transport unit 42. The controller 1 extends a distance between the line head 5 (the nozzles 51) and the belt transport unit 42. The controller 1 inserts an ink reception tray into a space which is produced. The ink reception tray receives the discharged ink. For example, in the ink reception tray, a sponge for absorbing the ink is provided. The controller 1 may insert a blade into the space which is produced. In this case, a movement mechanism is provided which moves the blade in the main scanning direction. The controller 1 makes the movement mechanism reciprocate the blade. In the reciprocation, the blade rubs the nozzles 51. The blade removes excess ink and stain from the nozzles 51. Cleaning using the blade does not need to be performed each time the forcible discharge is performed. After the forcible discharge or the cleaning using the blade, the controller 1 retracts the ink reception tray. The controller 1 returns (raises) the belt transport unit 42 to the original position.

When the operation panel 3 receives an instruction to perform the forcible discharge, the controller 1 may perform the forcible discharge. Each time the printer 100 prints a predetermined number of sheets, the controller 1 may perform the forcible discharge. The controller 1 may perform the forcible discharge at a preset time.

When the forcible discharge is performed, the controller 1 applies a pressure to the ink injected into the line head 5. A pressure higher than in normal discharge is applied to the nozzles 51. Since the pressure is applied, the controller 1 brings (closes) the first duct 61 (the first opening/closing portion 91) and the third duct 63 (the third opening/closing portion 93) into an interrupted state (see FIG. 7). The controller 1 also brings (closes) the fourth duct 64 (the fourth opening/closing portion 94) into the interrupted state. On the other hand, in order to feed the ink into the line head 5, the controller 1 brings (opens) the second duct 62 (the second opening/closing portion 92) into an opened state.

Furthermore, the controller 1 injects the ink into the syringe 8. The controller 1 rotates the syringe motor 85 so as to lower the moving member 82. In this way, the pressure is applied to the ink such that the ink is pushed out from the nozzles 51 of the line head 5. Here, the dumper 9 is formed with, for example, a metal plate. When in the forcible discharge, the pressure is applied to the ink, the dumper 9 may be deformed (swollen). By the deformation, the volume of the interior of the dumper 9 is increased.

For example, it is assumed that in the forcible discharge, M mL of the ink is injected from the syringe 8 into the dumper 9. It is also assumed that the dumper 9 is deformed and that thus the amount of the ink stored in the dumper 9 is increased by N mL. Then, the ink which is discharged in the forcible discharge is (M−N) mL. It is likely that the cleaning effect in the forcible discharge is not sufficiently achieved. It is also likely that the ink discharged in the forcible discharge is reduced and that thus it is impossible to appropriately manage the remaining amount of the ink.

Hence, the printer 100 has a change amount measurement mode. The change amount measurement mode is a mode in which an amount of change 21 (the amount of increase, the amount of deformation) in the amount of the ink stored in the dumper 9 caused by the deformation is measured. By this measurement, the controller 1 detects (recognizes) the amount of change 21. In the change amount measurement mode, the ink may drip from the nozzles 51. Hence, the controller 1 may arrange the ink reception tray below the line head 5.

(Processing in Change Amount Measurement Mode)

An example of flow of processing in the change amount measurement mode in the embodiment will then be described with reference to FIGS. 8 to 12. In the change amount measurement mode, three types of processing into which the processing is broadly divided are performed. The first one is pressure application processing. The second one is pressure release processing. The third one is liquid level lowering processing. The last pressure release processing is performed, and thereafter the liquid level lowering processing is performed. For each of the line heads 5 (the ink replenishers 6), the measurement is performed.

Figure 8:
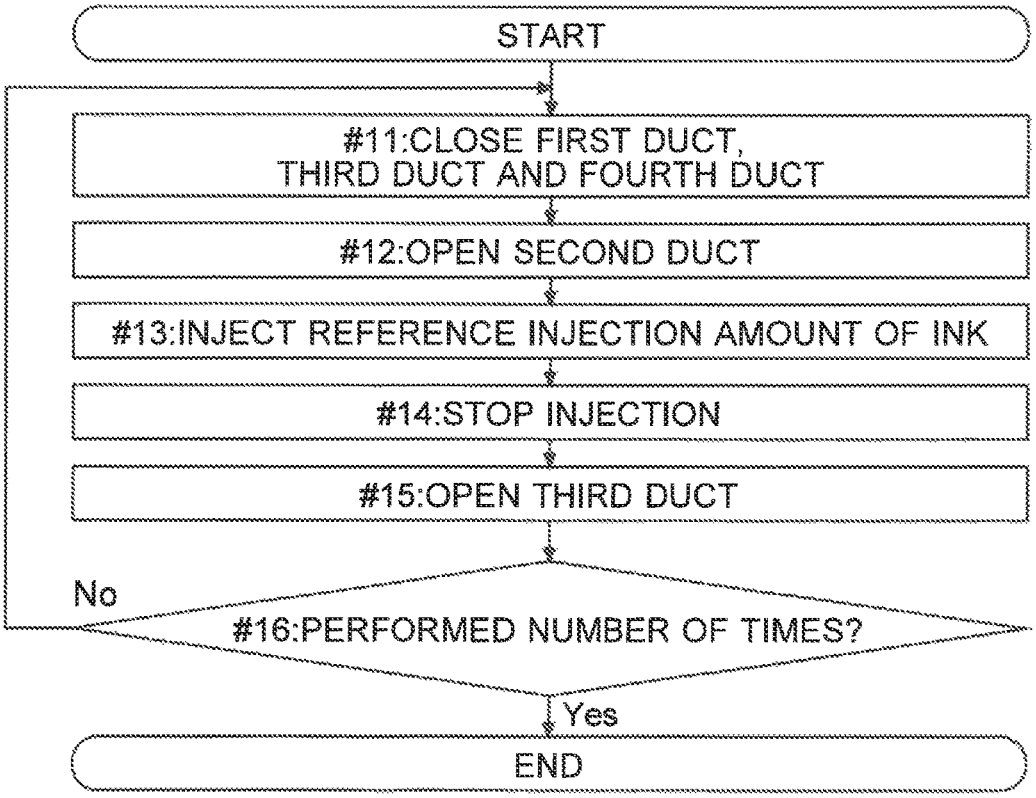
FIG. 8 is a diagram showing an example of pressure application processing and pressure release processing in the embodiment.
Figure 9:
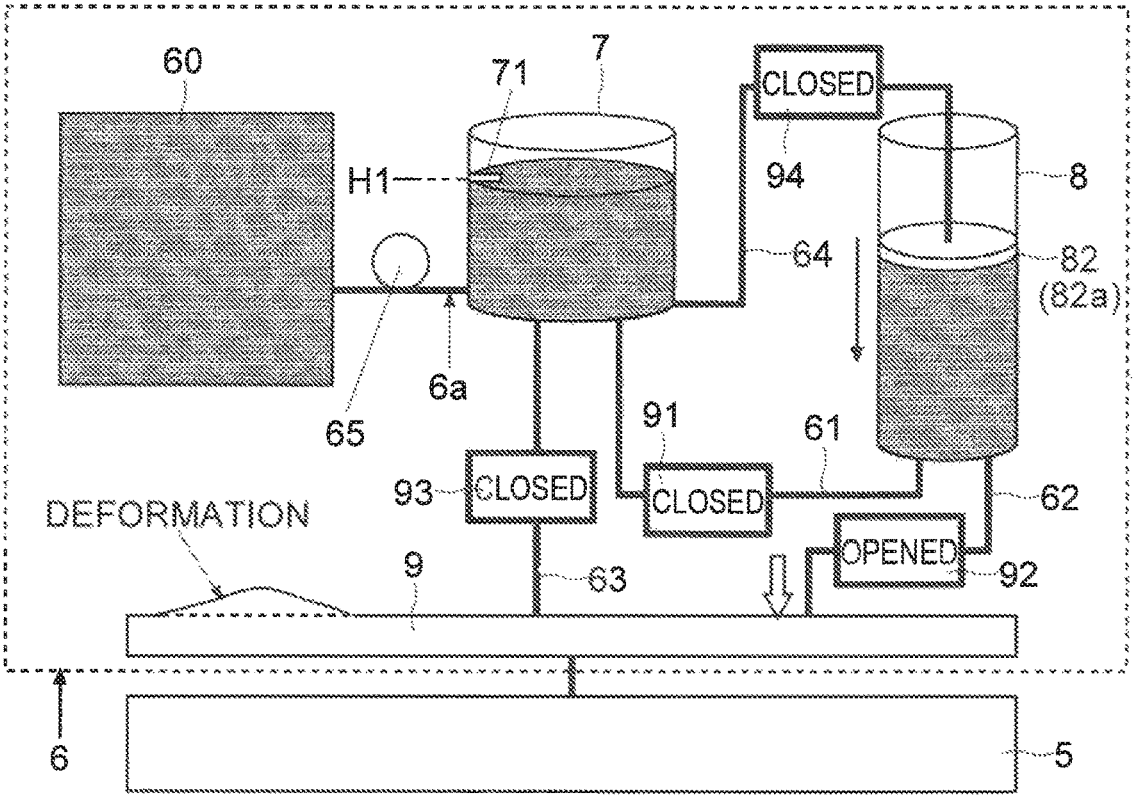
FIG. 9 is a diagram showing the example of the pressure application processing and the pressure release processing in the embodiment.
Figure 10:
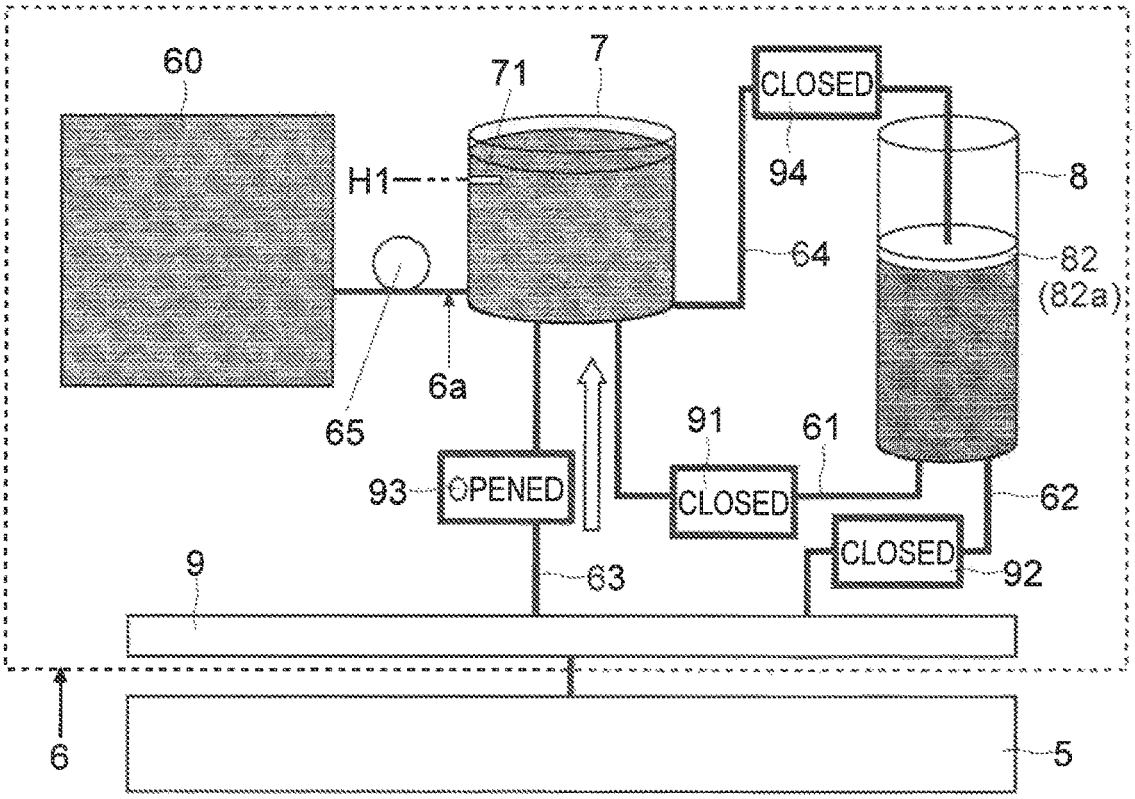
FIG. 10 is a diagram showing the example of the pressure application processing and the pressure release processing in the embodiment.

Examples of the pressure application processing and the pressure release processing will first be described with reference to FIGS. 8 to 10. The start of FIG. 8 is a time when the change amount measurement mode is started. It is also a time when the controller 1 starts the measurement of the amount of change 21 in the amount of the ink stored in the dumper 9 caused by the deformation. The operation panel 3 receives the start of the change amount measurement mode. When the measurement of the amount of change 21 is started, the user performs a predetermined operation on the operation panel 3. When the operation panel 3 receives the start of the change amount measurement mode, the controller 1 starts the processing of the flowchart of FIG. 8.

The controller 1 first closes the first duct 61, the third duct 63 and the fourth duct 64 (step #11). In other words, the controller 1 operates the first opening/closing portion 91, the third opening/closing portion 93 and the fourth opening/closing portion 94 so as to interrupt the flow paths of the first duct 61, the third duct 63 and the fourth duct 64 (see FIG. 9). The controller 1 also opens the second duct 62 (step #12). In other words, the controller 1 operates the second opening/closing portion 92 so as to bring the second duct 62 into the opened state (see FIG. 9).

Then, the controller 1 makes the syringe 8 inject a reference injection amount 22 of ink (step #13). The controller 1 moves the moving member 82 in a direction (downward direction) in which the ink is injected. Since the second duct 62 is opened, the ink is injected into the dumper 9 (see a white colored arrow in FIG. 9). The controller 1 rotates the syringe motor 85 so as to move the moving member 82 in the direction in which the ink is injected. The white colored arrow of FIG. 9 indicates the flow of the ink. The solid line arrow of FIG. 9 indicates the direction of movement of the moving member 82.

The reference injection amount 22 is previously determined. For example, by an experiment, the amount of the ink discharged from the nozzles 51 which makes it possible to perform sufficient cleaning is determined. The determined value can be set to the reference injection amount 22. The storage medium 2 stores the reference injection amount 22 in a nonvolatile manner (see FIG. 1).

After the ink is injected (pushed out) with the syringe 8, the controller 1 starts the pressure release processing. The controller 1 first stops the injection of the ink with the syringe 8 (step #14). The controller 1 opens the third duct 63 (step #15). The controller 1 operates the third opening/closing portion 93 so as to open the flow path of the third duct 63 (see FIG. 10). The controller 1 may close the first duct 61, the second duct 62 and the fourth duct 64. FIG. 10 shows a state where they are closed. Preferably, an amount of the ink corresponding to the amount of change 21 flows into (returns to) the tank 7. In steps #14 and #15, the pressure to the ink is released. The distortion (deformation) of the dumper 9 is returned to its original shape. Consequently, the amount of the ink corresponding to the amount of change 21 caused by the deformation is returned to the tank 7 (see a white colored arrow). The liquid level in the tank 7 is raised. The height (position) of the liquid level exceeds the specified position H1.

The controller 1 checks whether or not a combination of the pressure application processing and the pressure release processing is performed a predetermined number of times (step #16). The performed number of times is previously determined. When the number of times the combination of the pressure application processing and the pressure release processing is performed reaches the performed number of times (yes in step #16), the present flow is completed (end). When the number of times the combination of the pressure application processing and the pressure release processing is performed does not reach the performed number of times (no in step #16), the flow is returned to step #11.

The number of times the combination of the pressure application processing and the pressure release processing is performed may be once or a plurality of times. The operation panel 3 receives the setting of the number of times the combination is performed. The controller 1 performs the combination of the pressure application processing and the pressure release processing only the performed number of times which is set. When the performed number of times is once, each of the pressure application processing and the pressure release processing is performed once, and then the present flow is completed. When the performed number of times is a plurality of times, the combination of the pressure application processing and the pressure release processing is repeated a plurality of times, and then the present flow is completed.

Figure 11:
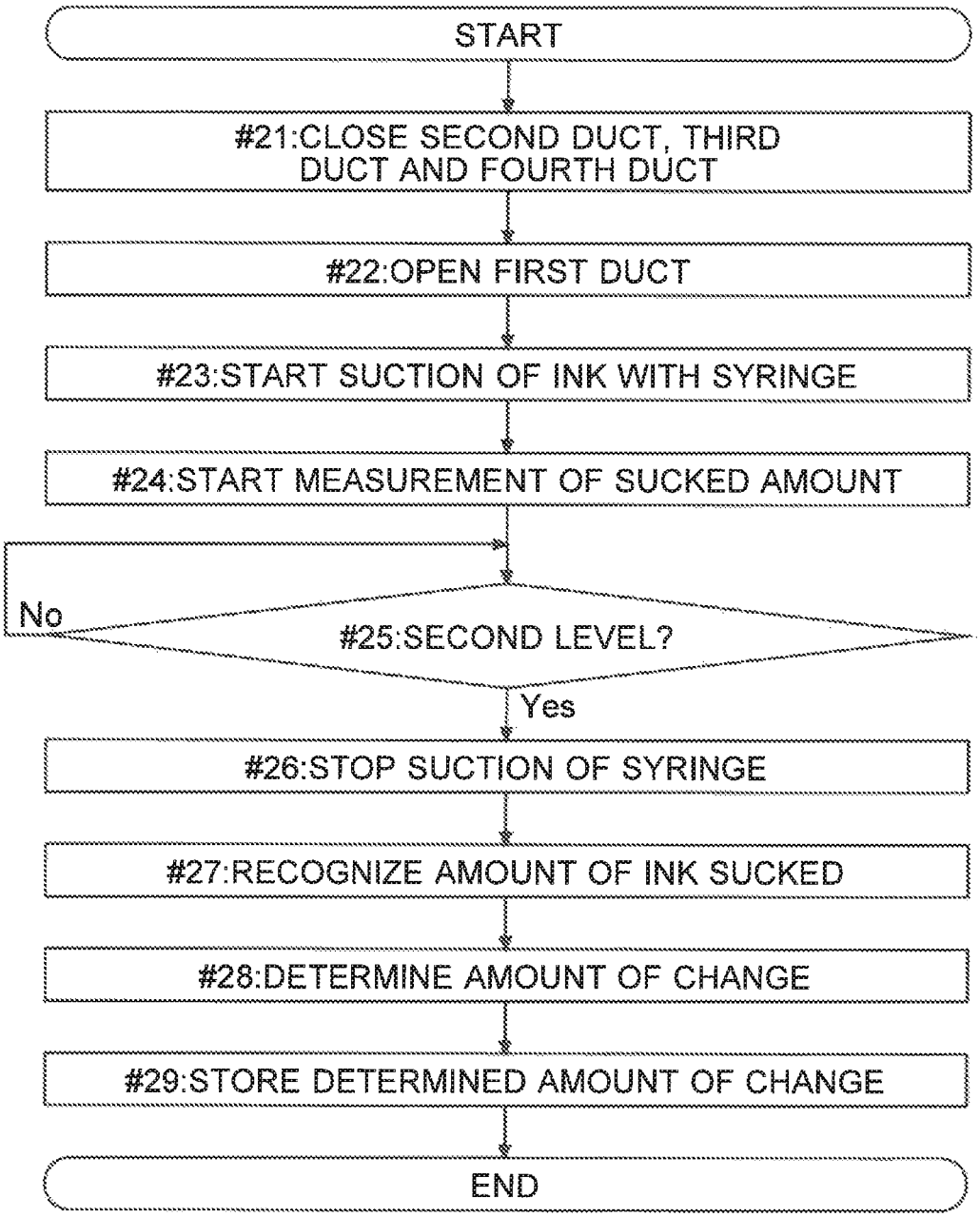
FIG. 11 is a diagram showing an example of liquid level lowering processing in the embodiment.
Figure 12:
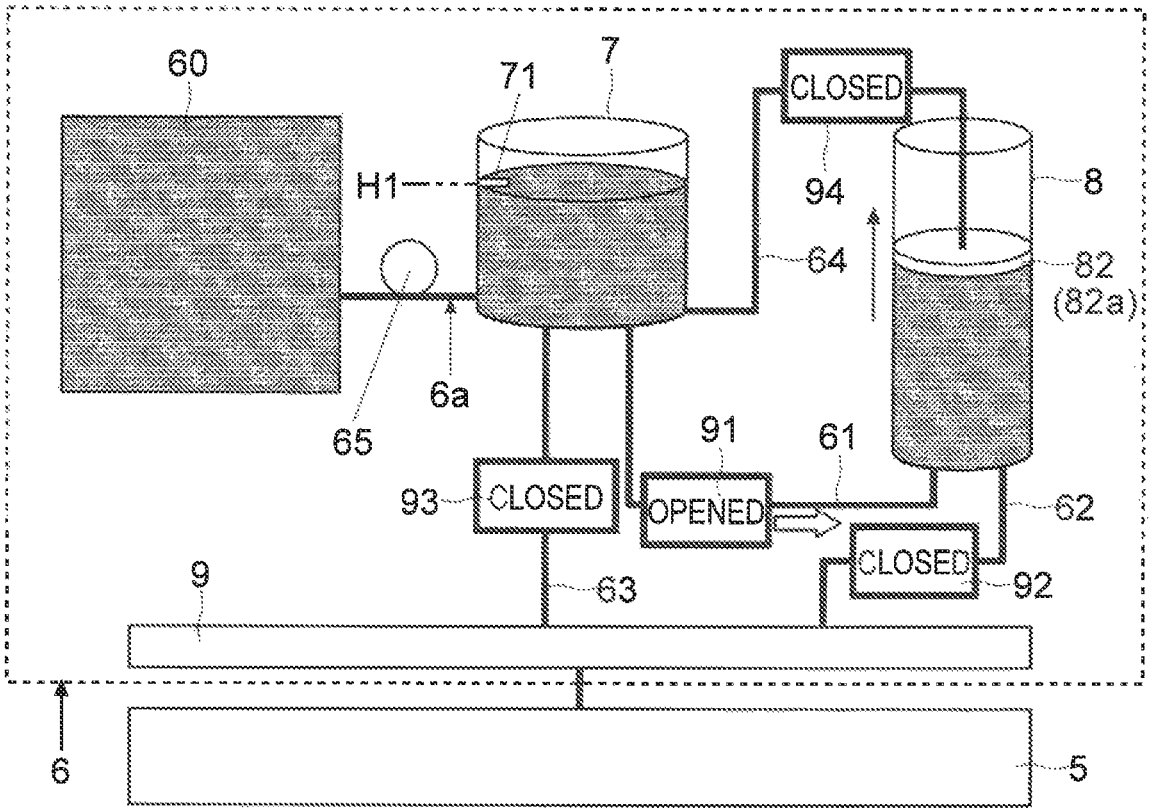
FIG. 12 is a diagram showing the example of the liquid level lowering processing in the embodiment.

An example of the liquid level lowering processing will then be described with reference to FIGS. 11 and 12. The start of the flowchart of FIG. 11 is a time when the flowchart of FIG. 8 is completed. The controller 1 first closes the second duct 62, the third duct 63, the fourth duct 64 (step #21). The controller 1 operates the second opening/closing portion 92 so as to interrupt the flow path of the second duct 62. In this way, it is impossible to exchange the ink between the syringe 8 and the dumper 9. The controller 1 operates the third opening/closing portion 93 so as to interrupt the flow path of the third duct 63. In this way, it is impossible to exchange the ink between the dumper 9 and the tank 7. The controller 1 operates air removal so as to interrupt the flow of the air in the fourth duct 64.

Then, the controller 1 opens the first duct 61 (step #22). The controller 1 operates the first opening/closing portion 91 so as to open the first duct 61. In this way, it is possible to exchange the ink between the tank 7 and the syringe 8. FIG. 12 shows a state where the individual pipes are opened and closed in the liquid level lowering processing.

The controller 1 makes the syringe 8 start the suction of the ink (step #23). The controller 1 moves the moving member 82 in a direction (upward direction) in which the ink is sucked. The controller 1 rotates the syringe motor 85 such that the moving member 82 is moved in the direction in which the ink is sucked. The white colored arrow of FIG. 12 indicates the flow of the ink. The solid line arrow of FIG. 12 indicates the direction of movement of the moving member 82.

Simultaneously with the suction of the ink, the controller 1 starts the measurement of a sucked amount (step #24). For example, the controller 1 counts the number of revolutions of the syringe motor 85. The amount of the ink sucked per revolution of the syringe motor 85 is fixed. The controller 1 can measure the amount of the ink sucked based on the number of revolutions and the rotation angle of the syringe motor 85 which are measured after the start of the suction.

The controller 1 continues to check whether or not the output of the liquid level sensor 71 reaches the second level (step #25, no in step #25→step #25). In other words, the controller 1 checks whether or not the syringe 8 sucks the ink until the position of the liquid level within the tank 7 is less than the specified position H1. The controller 1 makes the syringe 8 continue to suck the ink until the position of the liquid level within the tank 7 is less than the specified position H. In the change amount measurement mode, even when the output of the liquid level sensor 71 reaches the second level, the controller 1 does not immediately replenish the ink to the tank 7 (the controller 1 does not operate the pump 65).

When the output of the liquid level sensor 71 reaches the second level (yes in step #25), the controller 1 stops the suction of the syringe 8 (step #26). In other words, the controller 1 stops the rotation of the syringe motor 85.

The controller 1 recognizes the amount of the ink sucked by the syringe 8 after the start of the suction of the ink by the syringe 8 until the output of the liquid level sensor 71 is changed to the second level (step #27). In this way, the controller 1 recognizes the amount of the ink fed to the tank 7 in the pressure application processing and the pressure release processing after the start of the change amount measurement mode. For example, when the amount of the ink sucked per revolution of the syringe motor 85 is assumed to be P mL, and the number of revolutions of the syringe motor 85 after the start of the suction until the output of the liquid level sensor 71 is changed to the second level is 7.5 revolutions, the controller 1 recognizes that 7.5×P mL is the sucked amount.

The controller 1 determines, based on the sucked amount which is recognized, the amount of change 21 (the amount of increase) of the volume of the dumper 9 caused by the deformation (step #28). The controller 1 stores, in the storage medium 2, the amount of change 21 which is determined in a nonvolatile manner (step #29, see FIG. 1). Then, the present flow is completed (end).

When the number of times the combination of the pressure application processing and the pressure release processing is performed is once, the controller 1 recognizes, as the amount of change 21, the sucked amount which is recognized in the liquid level lowering processing.

When the combination of the pressure application processing and the pressure release processing is repeated a plurality of times (when the performed number of times is a plurality of times), the controller 1 recognizes, as the amount of change 21, a value obtained by dividing the sucked amount recognized in the liquid level lowering processing by the number of times the combination is repeated (the performed number of times which is set). For example, when the combination is repeated five times, the controller 1 divides the sucked amount recognized by five.

(Correction by Amount of Change 21 Recognized)

An example of a correction using the amount of change 21 which is recognized in the printer 100 according to the embodiment will then be described with reference to FIG. 1.

(1) Forcible Discharge

In the forcible discharge, the syringe 8 injects the ink into the dumper 9. When the pressure is applied so as to deform (swell) the dumper 9, the volume of the dumper 9 (the amount of the ink stored) is increased. By the deformation of the dumper 9, the amount of the ink discharged from the nozzles 51 is less than the reference injection amount 22. Hence, the controller 1 increases, based on the amount of change 21, the amount of the ink injected by the syringe 8 in the forcible discharge.

In the forcible discharge, the controller 1 closes the first duct 61 and the third duct 63. The controller 1 makes the first opening/closing portion 91 interrupt the flow path of the first duct 61. The controller 1 also makes the third opening/closing portion 93 interrupt the flow path of the third duct 63. Then, the controller 1 may make the syringe 8 inject, toward the dumper 9, an amount of the ink obtained by adding the reference injection amount 22 and the amount of change 21. In this way, even when the dumper 9 is deformed, the total amount of the ink discharged from the nozzles 51 is the reference injection amount 22.

(2) Management of Amount of the Ink Used

The storage medium 2 stores a cumulative used amount 23 in a nonvolatile manner (see FIG. 1). The cumulative used amount 23 is, for example, data for managing the amount of the ink used after a new ink container 60 is fitted until the current time. For example, when a value obtained by subtracting the cumulative used amount 23 from the amount of the ink stored at the time of full ink container 60 is equal to or less than a predetermined value, the controller 1 displays, on the display panel 31, a small remaining amount in the ink container 60. It is possible to provide, to the user, a notification that a time for replacement of the ink container 60 is approaching.

In the forcible discharge, the ink is consumed. It is necessary to add the amount of the ink consumed in the forcible discharge to the cumulative used amount 23. When the forcible discharge is performed, the controller 1 updates the cumulative used amount 23 in the storage medium 2. When an amount (added amount) of ink obtained by adding the reference injection amount 22 and the amount of change 21 is injected into the dumper 9, the controller 1 stores, as a new cumulative used amount 23, in the storage medium 2, a value obtained by adding the cumulative used amount 23 before being updated and the reference injection amount 22.

When the syringe 8 is made to inject only the reference injection amount 22 of ink, the controller 1 stores, as a new cumulative used amount 23, in the storage medium 2, a value obtained by adding a subtraction value to the cumulative used amount 23 before being updated. The subtraction value is a value obtained by subtracting the amount of change 21 from the reference injection amount 22.

(Processing in Time Measurement Mode)

An example of flow of processing in a time measurement mode in the embodiment will then be described with reference to FIGS. 13 to 18. As described above, when the pressure is applied to the ink, the dumper 9 is swollen. The pressure is released, and thus the shape of the dumper 9 is returned to its original shape (restored). During the restoration, the pressure to the ink is higher than in a normal state. During the restoration, for example, the ink flows toward the tank 7. Hence, during the restoration, it is likely that it is impossible to appropriately discharge the ink due to printing. Therefore, it is necessary to discharge the ink after the shape of the dumper 9 is restored.

The printer 100 has the time measurement mode. The time measurement mode is a mode in which a time (deformation restoration time 24) necessary for return (restoration) of the deformed (swollen) dumper 9 to its original shape is determined. This mode is performed, and thus the controller 1 measures the deformation restoration time 24. In the time measurement mode, the ink may drip from the nozzles 51. Hence, the controller 1 may arrange the ink reception tray below the line head 5.

In the time measurement mode, three types of processing into which the processing is broadly divided are performed. The first one is deformation processing. The second one is syringe filling processing. The third one is time measurement processing. The controller 1 performs the deformation processing, the syringe filling processing and the time measurement processing in this order. Based on the processing described above and the amount of change 21 which has already been determined, the controller 1 determines (finds) the deformation restoration time 24. The deformation restoration time 24 is measured for each of the line heads 5 (the ink replenishers 6).

Figure 13:
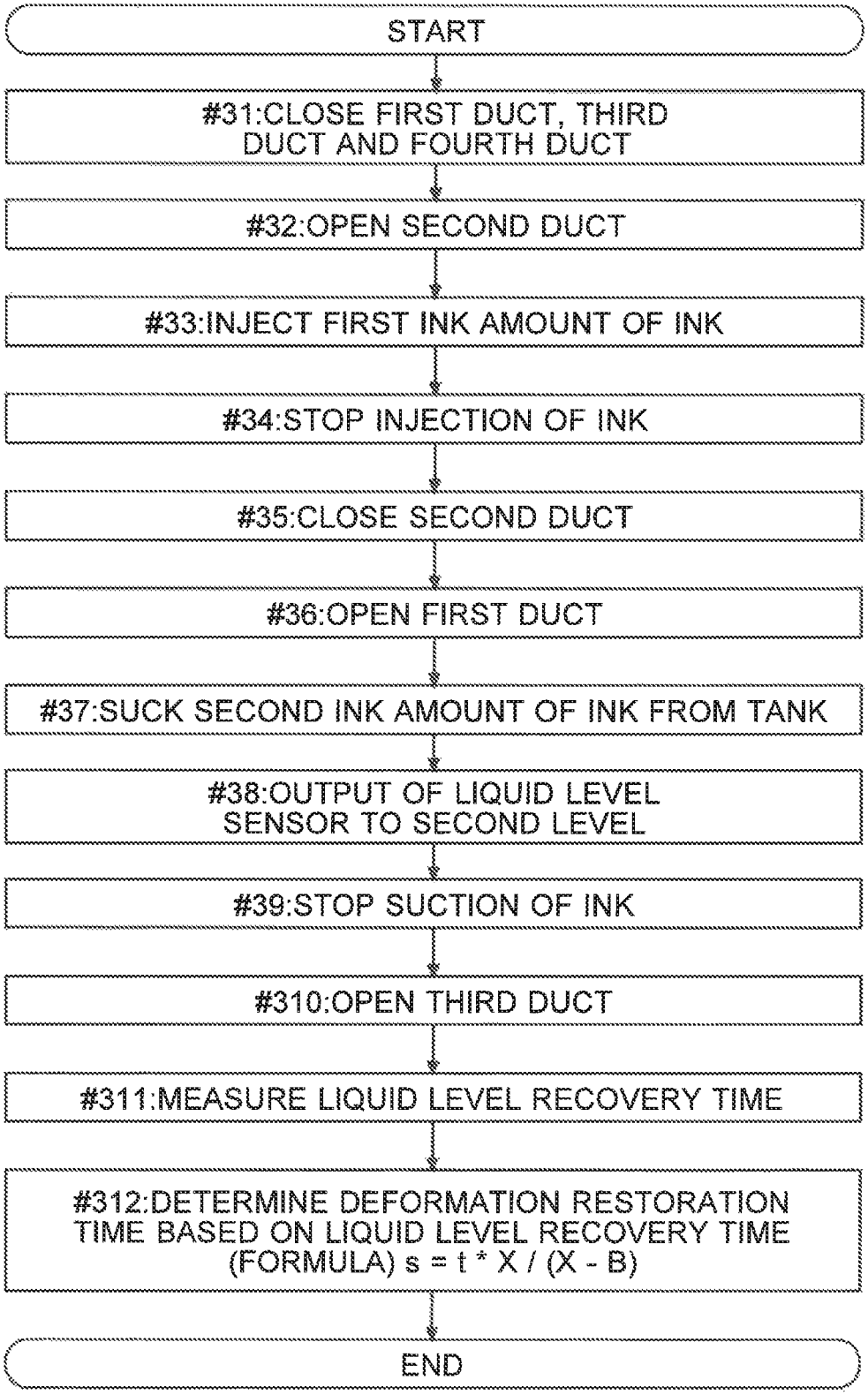
FIG. 13 is a diagram showing an example of flow of a time measurement mode in the embodiment.
Figure 14:
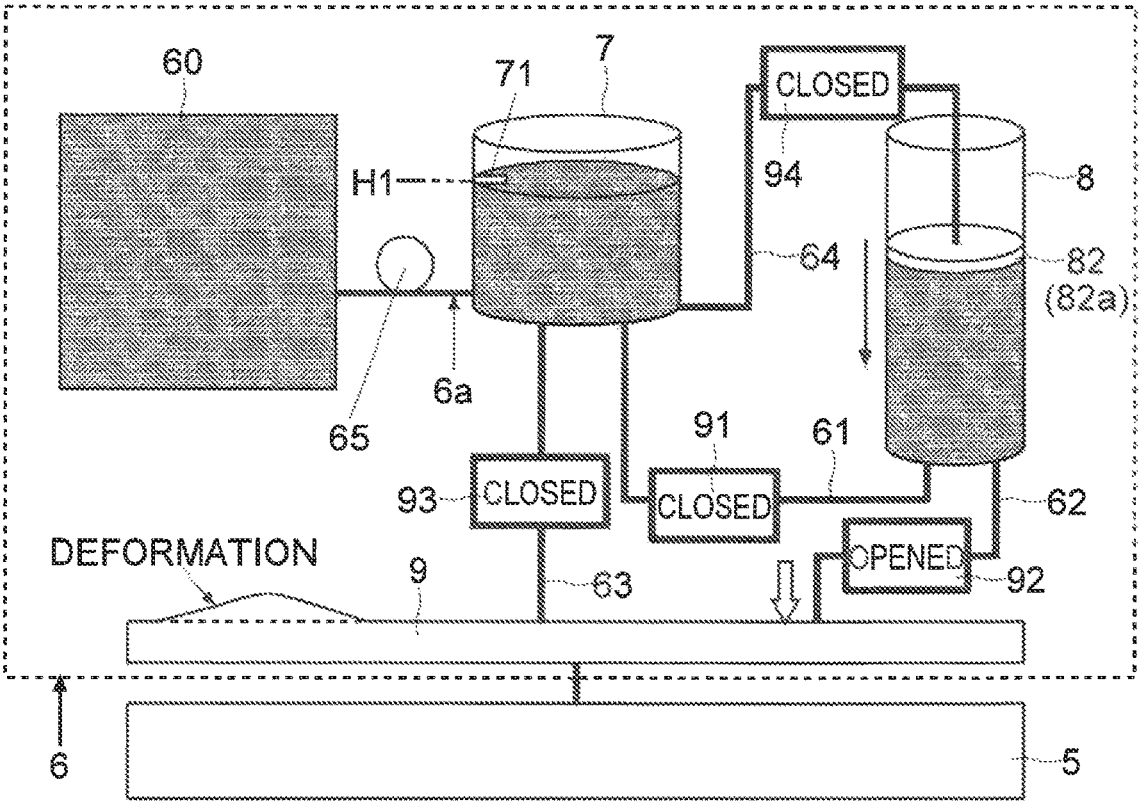
FIG. 14 is a diagram showing an example of deformation processing in the embodiment.
Figure 15:
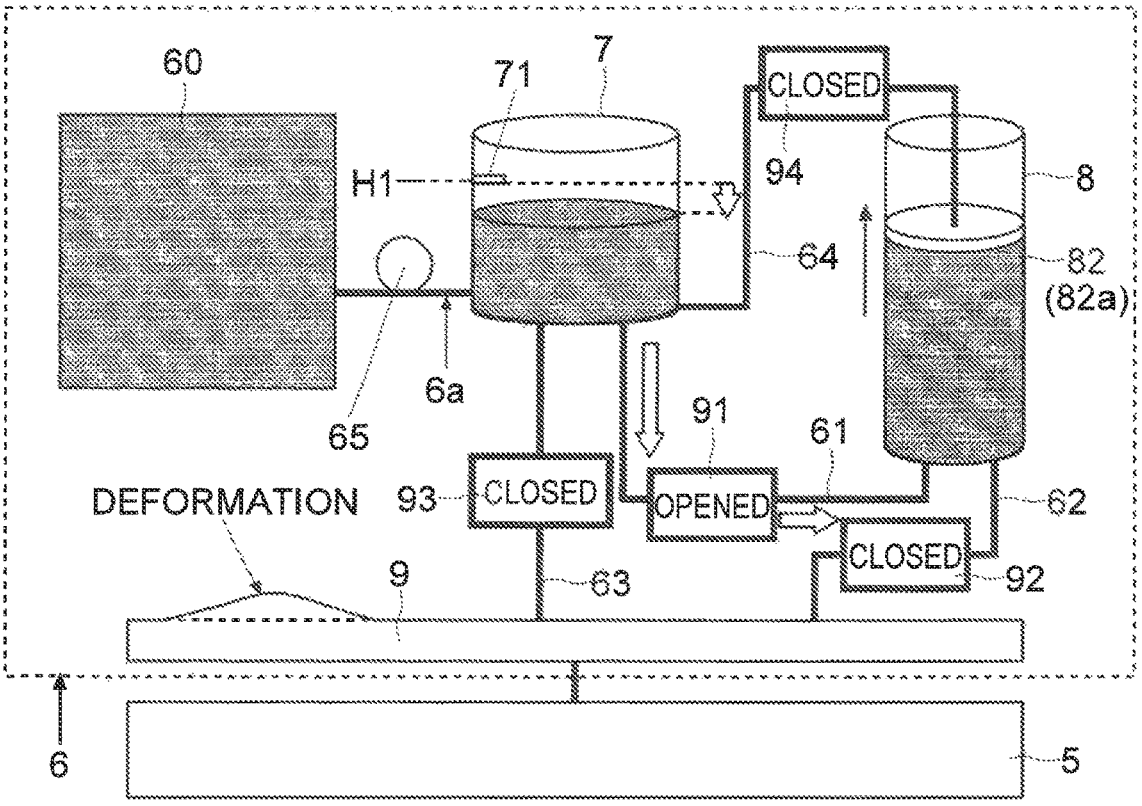
FIG. 15 is a diagram showing an example of syringe filling processing in the embodiment.

The start of FIG. 13 is a time when the time measurement mode is started. It is also a time when the controller 1 starts a measurement for determining the deformation restoration time 24. The operation panel 3 receives the start of the time measurement mode. When the deformation restoration time 24 is determined, the user performs a predetermined operation on the operation panel 3. When the operation panel 3 receives the start of the time measurement mode, the controller 1 starts the processing of the flowchart of FIG. 13.

As the deformation processing, the controller 1 first closes the first duct 61, the third duct 63 and the fourth duct 64 (step #31). In other words, the controller 1 operates the first opening/closing portion 91, the third opening/closing portion 93 and the fourth opening/closing portion 94 so as to interrupt the flow paths of the first duct 61, the third duct 63 and the fourth duct 64 (see FIG. 14). In a stage preceding step #31, the controller 1 adjusts the position of the liquid level in the tank 7 to the specified position H1. In this adjustment, the controller 1 uses the pump 65 and the syringe 8 so as to align the position of the liquid level with the specified position H1.

Then, the controller 1 opens the second duct 62 (step #32). In other words, the controller 1 operates the second opening/closing portion 92 so as to bring the second duct 62 into the opened state (see FIG. 14). Then, as the deformation processing, the controller 1 makes the syringe 8 inject a first ink amount of the ink (step #33). In this way, the dumper 9 is deformed. The controller 1 moves the moving member 82 in the direction (downward direction) in which the ink is injected. The controller 1 rotates the syringe motor 85 such that the first ink amount of the ink is injected. Since the second duct 62 is opened, the ink is injected into the dumper 9 (see a white colored arrow in FIG. 14). The white colored arrow of FIG. 14 indicates the flow of the ink with the syringe 8. The solid line arrow of FIG. 14 indicates the direction of movement of the moving member 82. The controller 1 rotates the syringe motor 85 such that the moving member 82 is moved in the direction in which the ink is injected.

The first ink amount can be determined with reference to the amount of change 21. In order to sufficiently deform the dumper 9, the first ink amount is set higher than the amount of change 21. The controller 1 can set, to the first ink amount, the amount of the ink obtained by adding a predetermined first adjustment amount 25 of ink to the amount of change 21. For example, the storage medium 2 stores, in the storage medium 2, the first adjustment amount 25 in a nonvolatile manner (see FIG. 1). In order to reduce the leakage of the ink from the nozzles 51, the first adjustment amount 25 is set lower than the amount of change 21.

The first adjustment amount 25 may be set equal to or less than half the amount of change 21. The first adjustment amount 25 may be set to about 20 to 40% of the amount of change 21. For example, when the amount of change 21 is 5 mL, the first adjustment amount 25 can be set to about 1 to 2 mL.

By an experiment, the amounts of change 21 in a plurality of image forming apparatuses may be checked. Then, among the amounts of change 21 which are obtained, a value which is lower than the minimum value may be determined to be the first adjustment amount 25. In other words, the first adjustment amount 25 may be a fixed value. On the other hand, the amount of change 21 is varied depending on the image forming apparatus. Hence, when the amount of change 21 is determined (found), the controller 1 may store, as the first adjustment amount 25, in the storage medium 2, a value obtained by multiplying the amount of change 21 by a predetermined ratio (equal to or less than 1).

When the syringe 8 injects the first ink amount of the ink into the dumper 9, the controller 1 makes the syringe 8 stop the injection of the ink (step #34). In this way, the deformation processing is completed. Then, the controller 1 closes the second duct 62 (step #35). The controller 1 opens the second opening/closing portion 92 so as to interrupt the flow path of the second duct 62 (see FIG. 15). It is impossible to exchange the ink between the syringe 8 and the dumper 9.

Then, the controller 1 opens the first duct 61 as the syringe filling processing (step #36). The controller 1 operates the first opening/closing portion 91 so as to open the flow path of the first duct 61 (see FIG. 15). The controller 1 keeps the second duct 62, the third duct 63 and the fourth duct 64 closed. Then, as the syringe filling processing, the controller 1 makes the syringe 8 suck a second ink amount of the ink from the tank 7 (step #37). The controller 1 moves the moving member 82 in the direction (upward direction) in which the ink is sucked. The controller 1 rotates the syringe motor 85 such that the second ink amount of the ink is sucked.

In this way, the position (height) of the liquid level in the tank 7 is lower than the specified position H1 (less than the specified position H1). Consequently, the output of the liquid level sensor 71 reaches the second level (level which indicates insufficiency). The controller 1 recognizes that the output of the liquid level sensor 71 reaches the second level (step #38). A white colored arrow of FIG. 15 indicates the flow of the ink with the syringe 8. The solid line arrow of FIG. 15 indicates the direction of movement of the moving member 82. A white colored arrow of FIG. 15 indicates the lowering of the liquid level in the tank 7. In the time measurement mode, even when the output of the liquid level sensor 71 reaches the second level, the controller 1 does not operate the pump 65. The controller 1 does not replenish the ink from the ink container 60 to the tank 7.

The second ink amount can also be determined with reference to the amount of change 21. The second ink amount can be set lower than the amount of change 21 such that the position of the liquid level in the tank 7 is less than the specified position H1 and that the liquid level in the subsequent processing is equal to or greater than the specified position H1. The controller 1 can set, to the second ink amount, the amount of the ink obtained by subtracting a predetermined second adjustment amount 26 of ink from the amount of change 21. For example, the storage medium 2 stores the second adjustment amount 26 in a nonvolatile manner (see FIG. 1).

The second adjustment amount 26 may be set equal to or less than half the amount of change 21. The second adjustment amount 26 may be set to about 20 to 40% of the amount of change 21. For example, when the amount of change 21 is 5 mL, the second adjustment amount 26 can be set to about 1 to 2 mL.

By an experiment, the amounts of change 21 in a plurality of image forming apparatuses may be checked. Then, among the amounts of change 21 which are obtained, a value which is lower than the minimum value may be determined to be the second adjustment amount 26. In other words, the second adjustment amount 26 may be a fixed value. On the other hand, the amount of change 21 is varied depending on the image forming apparatus. Hence, when the amount of change 21 is determined (found), the controller 1 may store, as the second adjustment amount 26, in the storage medium 2, a value obtained by multiplying the amount of change 21 by a predetermined ratio (equal to or less than 1).

The first adjustment amount 25 and the second adjustment amount 26 may be equal to each other. The first adjustment amount 25 is determined, and thus the second adjustment amount 26 is determined. The first adjustment amount 25 and the second adjustment amount 26 do not need to be determined separately.

Figure 16:
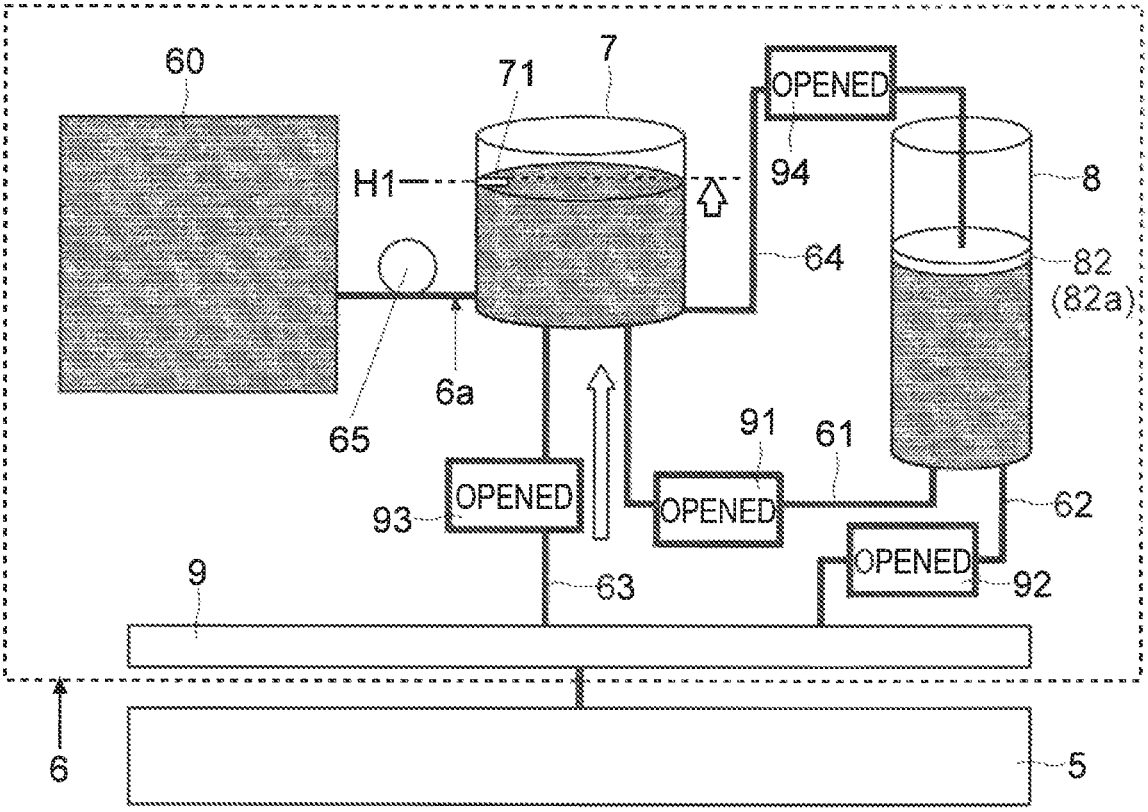
FIG. 16 is a diagram showing an example of time measurement processing in the embodiment.

When the syringe 8 sucks the second ink amount of the ink from the tank 7, the controller 1 makes the syringe 8 stop the suction of the ink (step #39). In this way, the syringe filling processing is completed. Then, the controller 1 opens the third duct 63 as the time measurement processing (step #310). The controller 1 operates the third opening/closing portion 93 so as to open the flow path of the third duct 63 (see FIG. 16). The controller 1 may close the first duct 61, the second duct 62 and the fourth duct 64. FIG. 16 shows a state where all the ducts are opened (all opened).

The third duct 63 is opened, and thus an amount of the ink corresponding to the amount of change 21 flows (returns) from the deformed dumper 9 into the tank 7. By the pressure release, the distortion (deformation) of the dumper 9 is returned to its original shape. In this process, the liquid level of the tank 7 is raised. In the process of the raising, the height (position) of the liquid level is equal to or greater than the specified position H1. A white colored arrow of FIG. 16 indicates the flow of the ink into the tank 7. A white colored arrow of FIG. 16 indicates the raising of the liquid level in the tank 7.

Then, the controller 1 measures a liquid level recovery time as the time measurement processing (step #311). The liquid level recovery time is a time which elapses after the third duct 63 is opened until the liquid level of the tank 7 is equal to or greater than the specified position H1. In other words, the liquid level recovery time is a time which elapses after the third duct 63 is opened until the output of the liquid level sensor 71 is changed to the first level. The controller 1 starts to measure the liquid level recovery time simultaneously with the opening of the third duct 63. When the output of the liquid level sensor 71 is changed from the second level to the first level, the controller 1 completes the measurement of the liquid level recovery time.

Then, the controller 1 determines the deformation restoration time 24 based on the liquid level recovery time which is measured (step #312). Then, the controller 1 completes the present flow (end). The controller 1 stores, in the storage medium 2, the determined deformation restoration time 24 in a nonvolatile manner (see FIG. 1).

The controller 1 determines the deformation restoration time 24 based on a formula below:

$$s = t \times X/(X-B) \quad \text{(Formula)}$$

where s represents the deformation restoration time 24;

t represents the liquid level recovery time;

X represents the amount of change 21 of the ink stored in the dumper 9 caused by the deformation of the dumper 9 (the amount of change 21 determined based on FIGS. 10 and 11); and (X−B) represents the second ink amount (B represents the second adjustment amount 26).

Based on a ratio between the amount of change 21 and the second ink amount and the liquid level recovery time, the accurate deformation restoration time 24 is determined.

(Operation Based on Determined Deformation Restoration Time 24)

An example of an operation based on the deformation restoration time 24 in the embodiment will then be described with reference to FIG. 17. There is a case where the printing (ink discharge) is desired to be restarted immediately after the completion of the forcible discharge of the ink. An example thereof is a case where the forcible discharge of the ink is started partway through the print job. It is likely that during the forcible discharge of the ink, the communication unit 13 receives print data.

Figure 17:
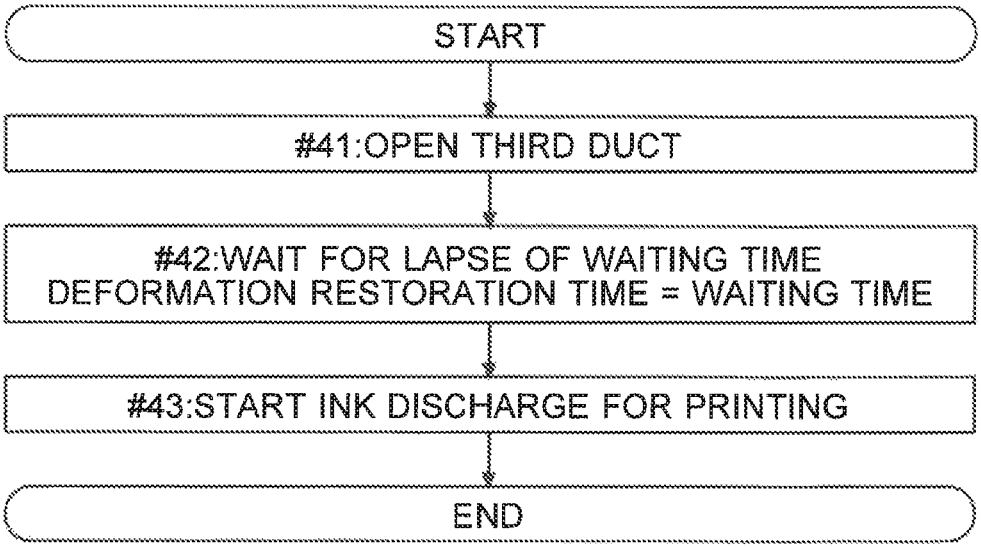
FIG. 17 is a diagram showing an example of an operation based on a deformation restoration time in the embodiment.

The flowchart of FIG. 17 is performed when the printing is started (restated) immediately after the forcible discharge of the ink. The start of FIG. 17 is a time when the application of the pressure to the ink is completed for the forcible discharge (cleaning) of the ink. In other words, the start of FIG. 17 is a time when the controller 1 stops the lowering of the syringe 8, that is, the injection of the ink into the dumper 9 and the line head 5. In the forcible discharge of the ink, in order to apply the pressure, the controller 1 closes the first duct 61, the third duct 63 and the fourth duct 64. On the other hand, the controller 1 opens the second duct 62.

The controller 1 first opens at least the third duct 63 (step #41). The controller 1 may close or open the first duct 61, the second duct 62 and the fourth duct 64. In this way, the shape restoration of the dumper 9 deformed by the forcible discharge of the ink is started.

Then, the controller 1 waits for the lapse of a waiting time after the third duct 63 is opened (step #42). Here, the controller 1 uses the deformation restoration time 24 as the waiting time. When the waiting time elapses, the controller 1 makes the heads 50 start the ink discharge for the printing (step #43). Thereafter, the controller 1 performs the print job until the end (end). The deformation restoration time 24 is used as the waiting time, and thus it is possible to start the printing immediately after the completion of the restoration of the deformed dumper 9. Moreover, the waiting time for the printing is minimized as needed.

(Precision Time Measurement Mode)

An example of flow of processing in a precision time measurement mode in the embodiment will be described with reference to FIG. 18. In the time measurement mode described previously, the liquid level recovery time is measured once, and based on the liquid level recovery time measured once, the deformation restoration time 24 is determined. As a separate mode for determining the deformation restoration time 24, the printer 100 has the precision time measurement mode. In the precision time measurement mode, the liquid level recovery time is measured a plurality of times. Based on a plurality of liquid level recovery times, the deformation restoration time 24 is determined. In the precision time measurement mode, the liquid level recovery time is measured a plurality of times, and thus it takes more time than in the time measurement mode.

Figure 18:
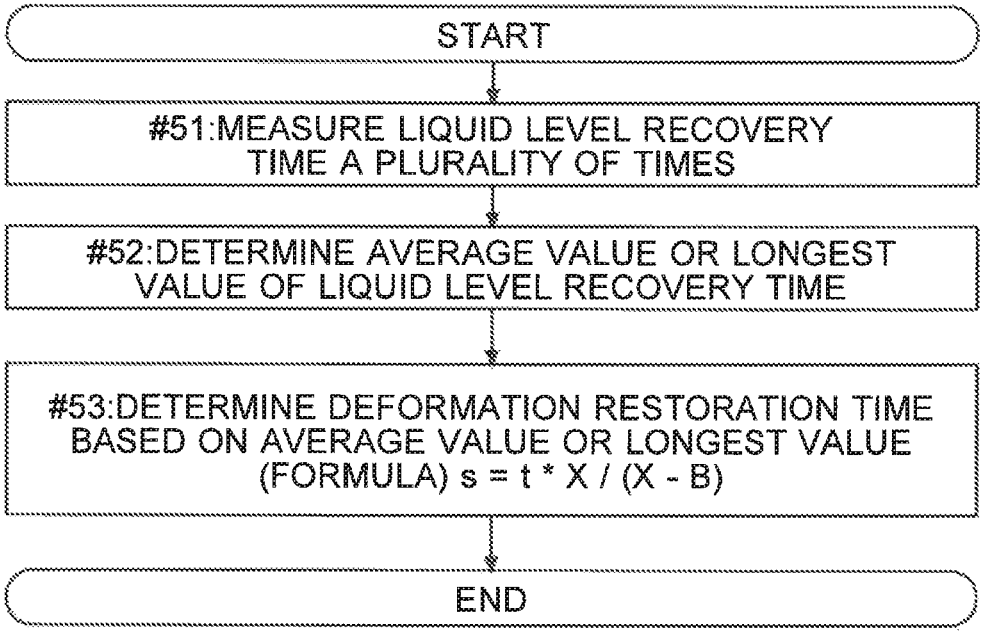
FIG. 18 is a diagram showing an example of a precision time measurement mode in the embodiment.

The start of FIG. 18 is a time when the precision time measurement mode is started. It is also a time when the operation panel 3 receives the start of the precision time measurement mode. In the printer 100, when the deformation restoration time 24 is determined, it is possible to select which one of the time measurement mode and the precision time measurement mode is used.

The controller 1 first measures the liquid level recovery time a plurality of times (step #51). Specifically, the controller 1 repeats, a plurality of times, steps #31 to #311 among the steps of the flowchart of FIG. 13. The number of times the steps are repeated may be previously determined (for example, five times). The operation panel 3 may receive the setting of the number of times the steps are repeated. In this case, the controller 1 repeats the steps the number of times which is set.

Then, the controller 1 determines the average value or the longest value of the liquid level recovery times measured a plurality of times (step #52). The operation panel 3 may receive the selection of any one of the average value and the longest value. When the operation panel 3 receives the selection of the average value, the controller 1 determines the average value. When the operation panel 3 receives the selection of the longest value, the controller 1 selects the longest time among the liquid level recovery times measured.

The controller 1 determines the deformation restoration time 24 based on the average value or the longest value (step #63→end). The controller 1 determines (finds) the deformation restoration time 24 based on a formula below:

$$s=t\times X/(X-B) \quad \text{(Formula)}$$

where s represents the deformation restoration time 24;

t represents the average value or the longest value of the liquid level recovery times;

X represents the amount of change 21 of the ink stored in the dumper 9 caused by the deformation of the dumper 9 (the amount of change 21 determined based on FIGS. 10 and 11); and (X−B) represents the second ink amount (B represents the second adjustment amount 26).

Based on the liquid level recovery times measured a plurality of times, the accurate deformation restoration time 24 is determined. The controller 1 stores, in the storage medium 2, the determined deformation restoration time 24 in a nonvolatile manner (see FIG. 1).

As described above, the image forming apparatus (printer 100) according to the embodiment includes the heads 50, the tank 7, the syringe 8, the dumper 9, the first duct 61, the second duct 62, the third duct 63, the liquid level sensor 71 and the controller 1. The heads 50 discharge the ink so as to perform the printing. The tank 7 stores the ink. The syringe 8 injects or sucks the ink. The dumper 9 supplies the ink to the heads 50, and the ink is injected with the syringe 8. The first duct 61 is a flow path for connecting the tank 7 and the syringe 8 together so as to exchange the ink. The second duct 62 is a flow path for connecting the syringe 8 and the dumper 9 together so as to exchange the ink. The third duct 63 is a flow path for connecting the dumper 9 and the tank 7 together so as to exchange the ink. The liquid level sensor 71 detects whether or not the position of the liquid level of the ink within the tank 7 is equal to or greater than the specified position H1. The output of the liquid level sensor 71 is input to the controller 1. In the change amount measurement mode for measuring the amount of change 21 of the ink stored in the dumper 9 caused by the deformation of the dumper 9, the controller 1 performs the pressure application processing, the pressure release processing and the liquid level lowering processing. The controller 1 performs the pressure release processing after the pressure application processing. In the pressure application processing, the controller 1 closes the first duct 61 and the third duct 63. Thereafter, the controller 1 makes the syringe 8 inject the ink into the dumper 9 so as to deform the dumper 9. After the deformation of the dumper 9, in the pressure release processing, the controller 1 makes the syringe 8 stop the injection of the ink into the dumper 9. The controller 1 opens the third duct 63. After the pressure release processing, the controller 1 performs the liquid level lowering processing. In the liquid level lowering processing, the controller 1 closes the second duct 62 and the third duct 63. The controller 1 makes the syringe 8 suck the ink in the tank 7 in a state where the first duct 61 is opened. The controller 1 recognizes the amount of the ink sucked by the syringe 8 after the start of the suction until the output of the liquid level sensor 71 is changed. Based on the sucked amount which is recognized, the controller 1 determines the amount of change 21.

By the pressure application processing, the pressure is intentionally applied to the ink, and thus it is possible to deform the dumper 9. By the pressure application processing, it is possible to return, to the tank 7, an amount of the ink (an amount of the ink corresponding to the amount of change 21 of the volume of the dumper 9 caused by the deformation) corresponding to the amount of change 21 of the ink stored in the dumper 9. Based on the amount of the ink sucked by the syringe 8 until the raised liquid level is returned to the specified position H1 as a result of the ink being returned to the tank 7, the amount of change 21 can be measured. It is possible to accurately find the amount of change 21.

In the change amount measurement mode, the controller 1 may perform each of the pressure application processing and the pressure release processing once. In this case, the controller 1 recognizes, as the amount of change 21, the sucked amount recognized in the liquid level lowering processing. Each of the pressure application processing, the pressure release processing and the liquid level lowering processing is performed only once, and thus it is possible to obtain (measure) the amount of change 21. With the minimum time, it is possible to rapidly measure the amount of change 21.

In the change amount measurement mode, the controller 1 may repeat the combination of the pressure application processing and the pressure release processing a plurality of times. In this case, when the controller 1 completes the last pressure release processing, the controller 1 starts the liquid level lowering processing. The controller 1 recognizes, as the amount of change 21, a value obtained by dividing the sucked amount recognized in the liquid level lowering processing by the number of times the combination is performed. It is possible to obtain, as the amount of change 21, the average value of the values measured a plurality of times. The pressure application processing and the pressure release processing are performed a plurality of times, and the average value of the ink returned to the tank 7 can be determined as the amount of change 21. The averaging is performed, and thus it is possible to determine the accurate value as the amount of change 21.

The image forming apparatus (printer 100) includes the first opening/closing portion 91 which switches the opening and closing of the first duct 61, the second opening/closing portion 92 which switches the opening and closing of the second duct 62 and the third opening/closing portion 93 which switches the opening and closing of the third duct 63. The opening and closing (opening and interrupting) of each of the first duct 61, the second duct 62 and the third duct 63 can be controlled.

In the forcible discharge in which the ink is forcibly discharged from the heads 50, the reference injection amount 22 of ink from the syringe 8 into the dumper 9 is previously determined. In the case of the forcible discharge, the controller 1 closes the first duct 61 and the third duct 63. When the ink is injected into the dumper 9, the controller 1 may inject, into the syringe 8, an amount of the ink obtained by adding the reference injection amount 22 and the amount of change 21. In the forcible discharge, even when the dumper 9 is deformed, a fixed amount of the ink can be forcibly discharged. Even when the deformation of the dumper 9 is individually different, a fixed amount (the reference injection amount 22) of ink can be forcibly discharged.

The image forming apparatus includes the storage medium 2 which stores the cumulative used amount 23. When the forcible discharge is performed, the controller 1 closes the first duct 61 and the third duct 63. When the amount of the ink obtained by adding the reference injection amount 22 and the amount of change 21 is injected into the dumper 9, the controller 1 adds the reference injection amount 22 so as to update the cumulative used amount 23 in the storage medium 2. When the syringe 8 injects the reference injection amount 22 of ink into the dumper 9, the controller 1 adds a value obtained by subtracting the amount of change 21 from the reference injection amount 22 so as to update the cumulative used amount 23 in the storage medium 2. It is possible to accurately manage the amount of the ink used in the image forming apparatus. The cumulative used amount 23 is appropriately managed, and thus it is possible to provide a notification of the accurate remaining amount of the ink. It is also possible to accurately provide a notification that the remaining amount of the ink is decreased.

In the image forming apparatus (printer 100) according to the embodiment, in the mode for determining the deformation restoration time 24 which is a time until the swollen dumper 9 is returned to its original shape, the controller 1 performs the deformation processing, the syringe filling processing and the time measurement processing in this order. In the deformation processing, the controller 1 closes the first duct 61 and the third duct 63, and thereafter makes the syringe 8 inject the first ink amount of the ink into the dumper 9 so as to deform the dumper 9. The controller 1 closes the second duct 62 after the deformation processing. In the syringe filing processing, the controller 1 opens the first duct 61 such that the position of the liquid level is less than the specified position, and makes the syringe suck the second ink amount of the ink from the tank. After the syringe filling processing, in the time measurement processing, the controller 1 opens the third duct 63, and measures the liquid level recovery time which is a time until the output of the liquid level sensor 71 is changed after the opening of the third duct 63. The controller 1 determines the deformation restoration time 24 based on the liquid level recovery time.

By the output of the liquid level sensor 71, the deformation processing, the syringe filling processing and the time measurement processing, it is possible to determine the time (deformation restoration time 24) necessary for restoring the deformed dumper 9. The deformation restoration time 24 is varied depending on the individual image forming apparatus. It is possible to determine the deformation restoration time 24 for each of image forming apparatuses. It is possible to measure a time for minimizing, as needed, the waiting time after the forcible discharge of the ink.

By the formula of $s=t\times X/(X-B)$, the controller 1 determines the deformation restoration time 24. Here, s represents the deformation restoration time 24, t represents the liquid level recovery time, X represents the amount of change 21 of the ink stored in the dumper 9 caused by the deformation of the dumper 9 and (X−B) represents the second ink amount. Based on the ratio between the amount of change 21 and the second ink amount and the time until the output of the liquid level sensor 71 is changed after the start of the restoration of the shape of the dumper 9, the accurate deformation restoration time 24 can be determined.

The controller 1 sets, to the first ink amount, the amount of the ink obtained by adding the predetermined first adjustment amount 25 of ink to the amount of change 21 of the ink stored in the dumper 9 caused by the deformation of the dumper 9. The controller 1 sets, to the second ink amount, the amount of the ink obtained by subtracting the predetermined second adjustment amount 26 of ink from the amount of change 21. The ink injected into the dumper 9 is adjusted, and thus it is possible to sufficiently swell (deform) the dumper 9. The amount of the ink subtracted from the tank 7 is adjusted, and thus in the time measurement processing, the liquid level of the tank 7 can be reliably restored to the specified position H1. It is possible to remove a measurement error which is caused by the fact that the liquid level of the tank 7 is not restored to the specified position H1

Each of the first adjustment amount 25 and the second adjustment amount 26 is less than the amount of change 21. It is possible to determine the first adjustment amount 25 and the second adjustment amount 26 so as to measure the liquid level recovery time.

The first adjustment amount 25 and the second adjustment amount 26 may be set equal to each other. The first adjustment amount 25 and the second adjustment amount 26 do not need to be set different from each other. The first adjustment amount 25 and the second adjustment amount 26 can be set equal to each other.

The controller 1 performs the combination of the deformation processing, the syringe filling processing and the time measurement processing a plurality of times so as to measure the liquid level recovery time a plurality of times. The controller 1 uses the average value or the longest value of a plurality of liquid level recovery times which are determined, and thereby determines the deformation restoration time 24. A plurality of measurements are performed, and thus it is possible to more accurately determine the deformation restoration time 24.

When the third duct 63 is closed, the syringe 8 is made to inject the ink into the dumper 9 and thus the ink is forcibly discharged, the controller 1 makes the heads 50 discharge the ink for printing after the waiting time has elapsed since the completion of the injection of the ink into the dumper 9. The controller 1 uses the deformation restoration time 24 as the waiting time. The determined deformation restoration time 24 can be set to the waiting time. The waiting time after the forcible discharge of the ink can be minimized as needed. The waiting time of the user can be minimized.

Although the embodiment of the present disclosure is described above, the scope of the present disclosure is not limited to this embodiment, and various modifications are possible without departing from the spirit of the disclosure.

What is claimed is:

1. An image forming apparatus comprising:

a head which discharges an ink so as to perform printing;

a tank which stores the ink;

a syringe which injects or sucks the ink;

a dumper which supplies the ink to the head and into which the ink is injected with the syringe;

a first duct which is a flow path for connecting the tank and the syringe together so as to exchange the ink;

a second duct which is a flow path for connecting the syringe and the dumper together so as to exchange the ink;

a third duct which is a flow path for connecting the dumper and the tank together so as to exchange the ink;

a liquid level sensor which detects whether or not a position of a liquid level of the ink within the tank is equal to or greater than a specified position; and a controller to which an output of the liquid level sensor is input, wherein in a mode for determining a deformation restoration time which is a time until the swollen dumper is returned to an original shape, the controller performs deformation processing, syringe filling processing and time measurement processing in this order, closes, in the deformation processing, the first duct and the third duct, and thereafter makes the syringe inject a first ink amount of the ink into the dumper so as to deform the dumper, closes the second duct after the deformation processing, opens, in the syringe filling processing, the first duct such that the position of the liquid level is less than the specified position, and makes the syringe suck a second ink amount of the ink from the tank, opens, in the time measurement processing after the syringe filling processing, the third duct, and measures a liquid level recovery time which is a time until the output of the liquid level sensor is changed after the opening of the third duct and determines the deformation restoration time based on the liquid level recovery time.

2. The image forming apparatus according to claim 1, wherein the controller uses a formula below so as to determine the deformation restoration time:

$$s=t\times X/(X-B)$$

where s represents the deformation restoration time;

t represents the liquid level recovery time;

X represents an amount of change of the ink stored in the dumper caused by the deformation of the dumper; and (X−B) represents the second ink amount.

3. The image forming apparatus according to claim 1, wherein the controller sets, to the first ink amount, an amount of the ink obtained by adding a predetermined first adjustment amount of the ink to an amount of change of the ink stored in the dumper caused by the deformation of the dumper, and sets, to the second ink amount, an amount of the ink obtained by subtracting a predetermined second adjustment amount of the ink from the amount of change.

4. The image forming apparatus according to claim 3, wherein each of the first adjustment amount and the second adjustment amount is less than the amount of change.

5. The image forming apparatus according to claim 3, wherein the first adjustment amount and the second adjustment amount are equal to each other.

6. The image forming apparatus according to claim 1, wherein the controller performs a combination of the deformation processing, the syringe filling processing and the time measurement processing a plurality of times so as to measure the liquid level recovery time a plurality of times, and uses an average value or a longest value of the measured liquid level recovery times so as to determine the deformation restoration time.

7. The image forming apparatus according to claim 6, comprising:

an operation panel which receives a selection of any one of the average value and the longest value, wherein when the operation panel receives the selection of the average value, the controller determines the average value of the liquid level recovery times whereas when the operation panel receives the selection of the longest value, the controller selects the longest time among the measured liquid level recovery times.

8. The image forming apparatus according to claim 1, wherein when the third duct is closed and the syringe is made to inject the ink into the dumper such that the ink is forcibly discharged, the controller makes the head discharge the ink for the printing after a waiting time has elapsed since completion of the injection of the ink into the dumper and uses the deformation restoration time as the waiting time.

9. The image forming apparatus according to claim 1, wherein in a mode for measuring an amount of change of the ink stored in the dumper caused by the deformation of the dumper, the controller performs pressure application processing, pressure release processing and liquid level lowering processing, performs the pressure release processing after the pressure application processing, closes, in the pressure application processing, the first duct and the third duct, and thereafter makes the syringe inject the ink into the dumper so as to deform the dumper, makes, in the pressure release processing after the deformation of the dumper, the syringe stop the injection of the ink into the dumper and opens the third duct, performs the liquid level lowering processing after the pressure release processing, closes, in the liquid level lowering processing, the second duct and the third duct, makes the syringe suck the ink in the tank in a state where the first duct is opened and recognizes an amount of the ink sucked by the syringe until the output of the liquid level sensor is changed after start of the suction and determines the amount of change based on the sucked amount which is recognized.

10. A method of controlling an image forming apparatus, the method comprising:

discharging an ink with a head so as to perform printing;

storing the ink in a tank;

using a syringe so as to inject or suck the ink;

using a dumper so as to supply the ink to the head;

using the syringe so as to inject the ink into the dumper;

using a first duct so as to connect the tank and the syringe together;

using a second duct so as to connect the syringe and the dumper together;

using a third duct so as to connect the dumper and the tank together; and using a liquid level sensor so as to detect whether or not a position of a liquid level of the ink within the tank is equal to or greater than a specified position;

wherein in a mode for determining a deformation restoration time which is a time until the swollen dumper is returned to an original shape, the method includes:

performing deformation processing, syringe filling processing and time measurement processing in this order;

closing, in the deformation processing, the first duct and the third duct, and thereafter making the syringe inject a first ink amount of the ink into the dumper so as to deform the dumper;

closing the second duct after the deformation processing;

opening, in the syringe filling processing, the first duct such that the position of the liquid level is less than the specified position, and making the syringe suck a second ink amount of the ink from the tank;

opening, in the time measurement processing after the syringe filling processing, the third duct, and measuring a liquid level recovery time which is a time until the output of the liquid level sensor is changed after the opening of the third duct; and determining the deformation restoration time based on the liquid level recovery time.

* * * * *